United States Patent [19]

Davies et al.

[11] 4,208,158

[45] Jun. 17, 1980

[54] AUXILIARY OFFSHORE RIG AND METHODS FOR USING SAME

[75] Inventors: Philip H. Davies; Franklin M. Lohning, both of Sugar Land, Tex.

[73] Assignee: Franklin Enterprises, Inc., Suger Land, Tex.

[21] Appl. No.: 895,235

[22] Filed: Apr. 10, 1978

[51] Int. Cl.[2] ..... E21B 19/00

[52] U.S. Cl. ..... 414/22; 175/85; 211/60 S; 405/201; 414/745; 414/786

[58] Field of Search ..... 414/22, 745, 786; 175/5, 52, 85; 211/60 S; 166/79; 405/195, 201

[56] References Cited

U.S. PATENT DOCUMENTS

| | | | |
|---|---|---|---|
| 945,086 | 1/1910 | Fensom | 175/5 |
| 2,187,392 | 1/1940 | Chappell | 414/22 X |
| 2,311,932 | 2/1943 | Deckard | 211/60 S |
| 3,658,298 | 4/1972 | Moore et al. | 414/22 X |
| 3,949,818 | 4/1976 | Russell | 414/22 X |
| 3,981,369 | 9/1976 | Bokenkamp | 175/5 |

FOREIGN PATENT DOCUMENTS

| | | | |
|---|---|---|---|
| 138904 | 8/1961 | U.S.S.R. | 175/85 |

*Primary Examiner*—L. J. Paperner

*Attorney, Agent, or Firm*—Pravel, Gambrell, Hewitt, Kirk, Kimball & Dodge

[57] ABSTRACT

An auxiliary offshore rig adapted to be used for relieving the primary offshore rig on an offshore platform of well activities relating to tubular member or cable operations. The auxiliary offshore rig includes in one embodiment a truss member mounted for movement along the platform, a racking tower for receiving tubular members therein mounted on the truss member, and a working cage mounted within the racking tower and supported by the truss member adapted to be positioned in alignment with the well for providing a secondary working area beneath the rig floor which is mounted atop the racking tower. In a second embodiment, the auxiliary offshore rig includes the truss member, the racking tower, and a drill tower which is mounted atop the racking tower for use in drilling operations, the drill tower supporting a crown block assembly movably mounted upon a crown block support member mounted with the upper end of the drill tower, with the crown block assembly supporting a travelling block for vertically moving tubular members with respect to the racking tower.

34 Claims, 18 Drawing Figures

P
38
36
32
34
30
24a
24
76
90
62
M
40
64
96
140
228
212
194
214
C
210
206
208
218b
196
218
218a
186
192
188
202
10
216
D
190
204
198
200
80
80a
68
R
48b
48
48a
T
92
92a
52
18
O
14
28a
28
50
46f
46
46c
61
98
W
144
22
94
46b
60
46a
15
15
26
26a
12
12a

A
218a
222c
222a
234
190
D
204
216
226
230
238
142
142b
240
80
44
68
103
140
78
94
48
46
46a
T
18
O
46d
28
218
214
222
C
220
220c
220a
188
226
230
236
142
142a
202
304b
186
174
172
110
242
62
104a
104
J
R
92
W
144
48a
50
26

218
218a
188
216
190
204
D
198
230
142b
216
174
172
110
80
68
104a
44
103
W
78
94
48a
46a
46d
28
222b
214
222
220
220b
220c
C
220a
222a
232
234
226
228
236
142a
142
304a
304b
306
304
62
104
J
R
92
140
144
B
50
48
T
46
26
18
O

A
218
218a
230
238
246
302e
D
190
222
222b
220a
220
220b
220c
224
188
186
232
42
302d
302
228
236
110a
110
108
106
104b
J
104a
103
78
W
144b
144
146
R
318
302c
92
144a
B
48
46
50
26
46d
28
T
18
O
222c
222a
234
174
172
80
C

Fig. 15
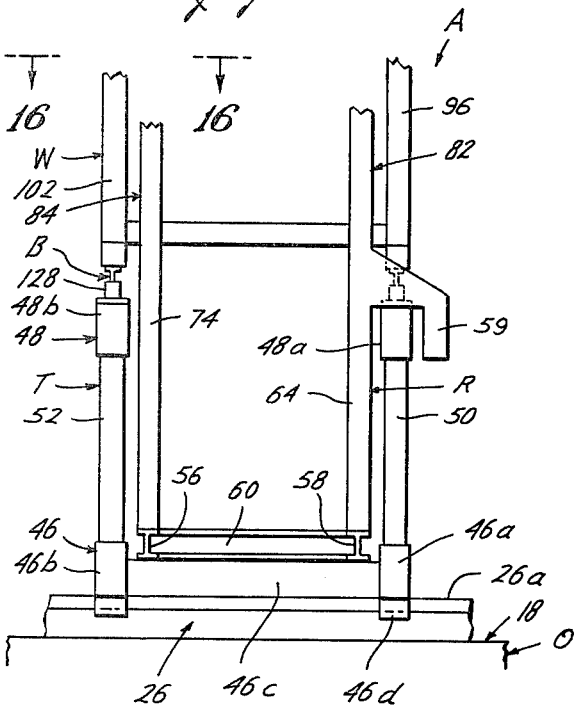
Fig. 18
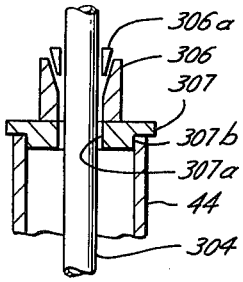
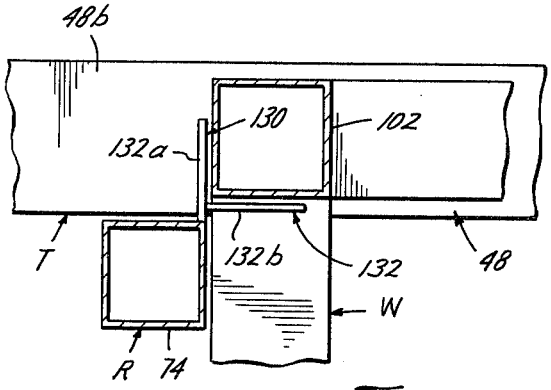
Fig. 16
Fig. 17
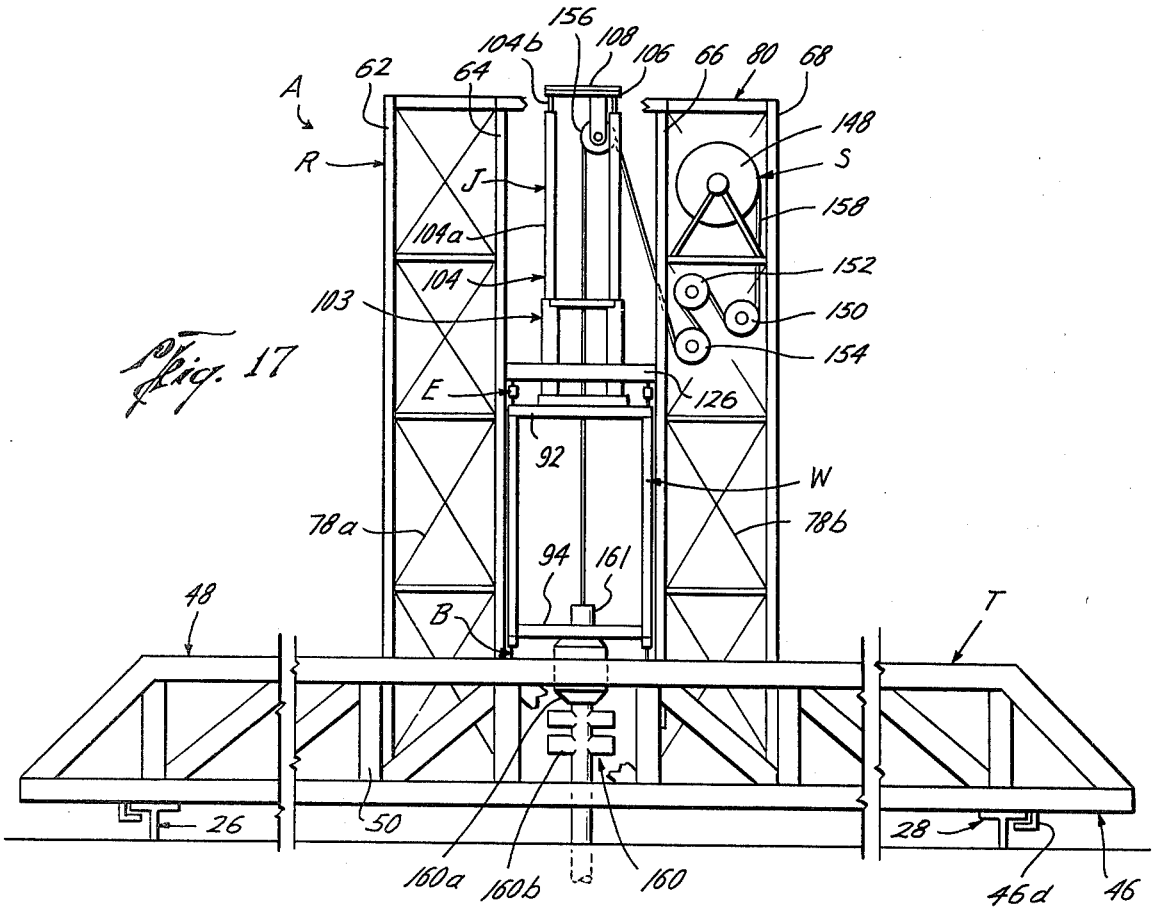

AUXILIARY OFFSHORE RIG AND METHODS FOR USING SAME

BACKGROUND OF THE INVENTION

The field of this invention relates to offshore rigs, particularly the type adapted to be mounted on an offshore platform.

So far as known, it is typical for a single rig to be movably mounted on skids on the offshore platform to allow the rig to be movably disposed about the center line of numerous wells that are typically serviced by the off-shore platform. Such a rig typically performs many different types of functions about the offshore platform. These operations may include performing functions as a service rig, providing for downhole pump maintenance, being used for initial well completion as well as for recompletion of such wells, for casing tie-backs from subsea wellheads, and for drilling, running and cementing of tubular members. In most instances, these operations occur at relatively shallow depths with respect to the mud line of the ocean floor which supports the offshore platform. However, to perform these functions, it is heretofore been necessary that the main rig be tied up performing these functions, which, because of the significant costs involved in using such a rig, typically run on the order of $15,000.00 per day.

Typical activities such as downhole pump maintenance are complicated by the fact that an electricalhydraulic conductor attached to a tubular member and/or an electrical conductor-cable must be reeled in along with the removal of the pump from the downhole position. In most instances, such operations all take place on the deck of the rig requiring multiple people and operations to be occurring simultaneously at one area which not only hinders the speed at which such may be removed from the well, but also increases the potential of safety hazards.

Also, because of the tremendous weights involved, it has been found that upon making connection of the service riser with the rig that significant compressive loading on the service riser may result. This compressive loading in addition to the normal stresses and strains encountered by the riser may lead to premature failure of its component parts, which could result in costly time delays.

Still further, in most applications a mousehole is used for storing such tubular members as drilling pipe prior to their actually being used in drilling operations of the rig. However, once the pipe that is in the mousehole is used, the mousehole must then be resupplied for further use. This procedure thus results in a time-consuming operation which, because of the large costs involved, can be significant.

Furthermore, so far as known, no structure for providing lifting capabilities for an offshore rig has been mounted with the upper end of a racking mechanism to permit vertical lifting and straight-line movement of such elevated tubular members, such as casing, as opposed to angularly disposed or otherwise positioned lifting and/or rotational movement thereafter of such tubular members. To provide for such a vertical raising and lowering of tubular members, then a requirement exists that the center line of the lifting mechanism be able to move from a position where it is aligned over the object to be lifted, thereafter being capable of lifting the same, and disposing it in such a manner that it is substantially aligned with the center line of the well. So far as known, no such structure has been employed in the field of offshore rig operations on an offshore platform.

SUMMARY OF THE INVENTION

An auxiliary offshore rig and methods for using same wherein the auxiliary offshore rig is adapted to be used in conjunction with a primary offshore rig on an offshore platform for relieving the primary offshore rig of well activities relating to tubular member or cable operations. The auxiliary offshore rig includes in one embodiment a truss member mounted for movement along the offshore platform, a racking tower for receiving tubular members therein and mounted on the truss member, and a working cage mounted within the racking tower and supported by the truss member adapted to be positioned in alignment with the well for providing a secondary working area beneath the rig floor which is mounted atop the racking tower. In a second embodiment, the auxiliary offshore rig includes the truss member, the racking tower, and a drill tower which is mounted atop the racking tower for use in drilling operations, the drill tower supporting a crown block assembly movably mounted upon a crown block support member mounted with the upper end of the drill tower, with the crown block assembly supporting a travelling block for vertically raising and lowering tubular members with respect to the racking tower. The methods for using the auxiliary offshore rig of the present includes in one instance the coordinated, simultaneous raising and lowering of tubular members into the well in order to reduce tripping time into the well. Further, the methods of the present invention include a procedure whereby the tubular member supported by the offshore rig is connected with a service riser in such a fashion as to prevent compressive loading on the service riser with any live loads.

BRIEF DESCRIPTION OF THE DRAWINGS

FIG. 15 is a side elevational detail showing the specific structural configuration and relationship of the truss member, racking tower, and working cage of the auxiliary offshore rig of the present invention;

FIG. 16 is a plan view showing a portion of the working cage, racking tower, and truss member of the present invention, taken along the lines 16—16 of FIG. 15;

FIG. 17 is an elevational view of the auxiliary offshore rig of the present invention as used in downhole pump maintenance, wherein the downhole pump is cable supported requiring a reeling mechanism, which in the present invention is mounted with the racking tower; and, FIG. 18 is an elevational detail showing the mounting of a slip insert plate atop the guide casing for mounting slips therewith for engaging drill pipe adapted to be disposed therein.

BRIEF DESCRIPTION OF THE PREFERRED EMBODIMENTS

Figure 1:
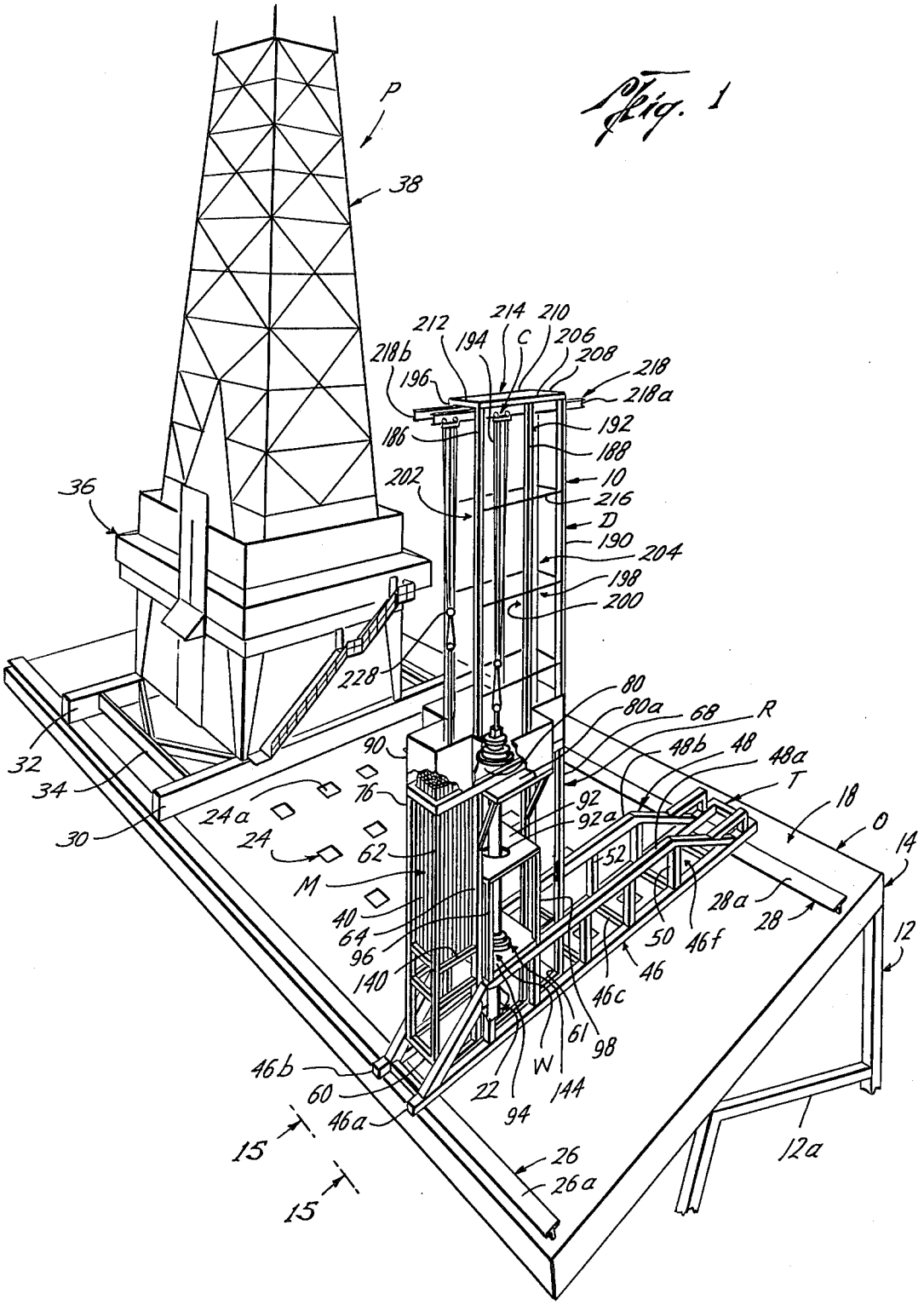
FIG. 1 is a perspective view of the auxiliary offshore rig of the present invention as mounted on an offshore platform adjacent to the primary offshore rig.

In the drawings, the letter A designates generally the auxiliary offshore rig of the present invention. The auxiliary offshore rig A is adapted to be used in conjunction with a primary offshore rig P. Both the auxiliary offshore rig A and the primary offshore rig P are adapted to be mounted on an offshore platform O. The auxiliary offshore rig A is adapted to relieve the primary offshore rig P of well activities relating to tubular member or cable operations.

Generally, the auxiliary offshore rig A of the present invention includes truss member T having a racking tower R and movably mounted thereon with a drill tower D atop the racking tower R. A working cage W is disposed within the racking tower R and supported by the truss member T, with the working cage W having jacking means J and elevation means E in engagement therewith. The drill tower D has crown block means C therewith. Spooler means S is adapted to be mounted with the truss member T. Unless otherwise specified, it is preferred that the components of the auxiliary offshore rig A of the present invention is preferably made of steel or other suitable high strength components capable of taking heavy stresses and strains without failure thereof.

Figure 14:
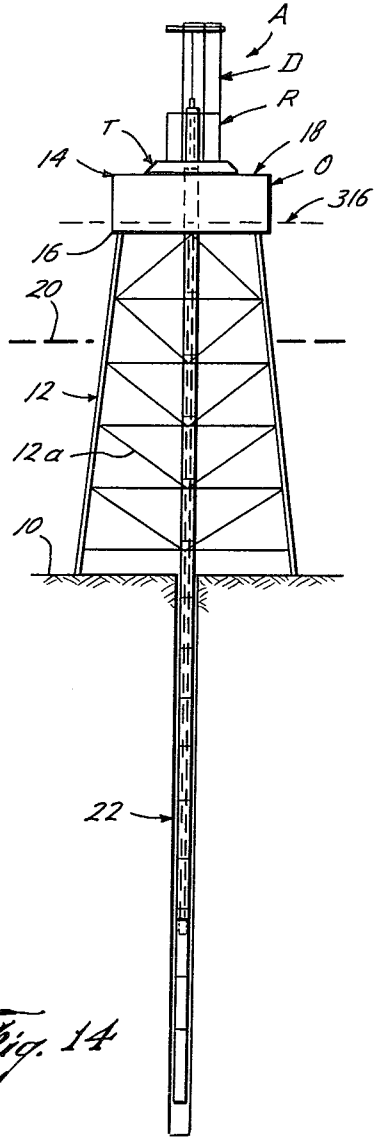
FIG. 14 shows an elevational, schematic view of the auxiliary offshore rig mounted on an offshore platform as used in cementing the casing string within the well.
Figure 13:
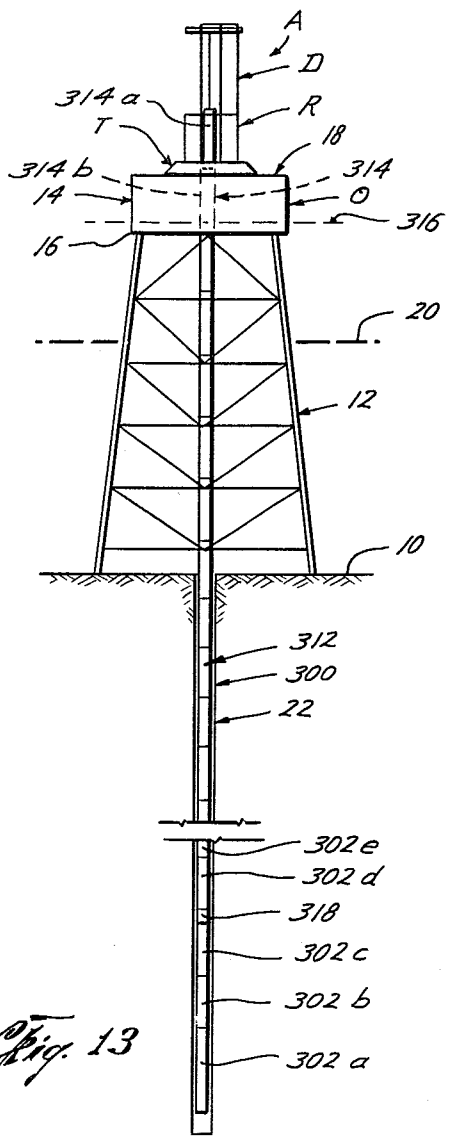
FIG. 13 shows an elevational, schematic view of the auxiliary offshore rig mounted on an offshore platform as used in completing the casing string.
Figure 12:
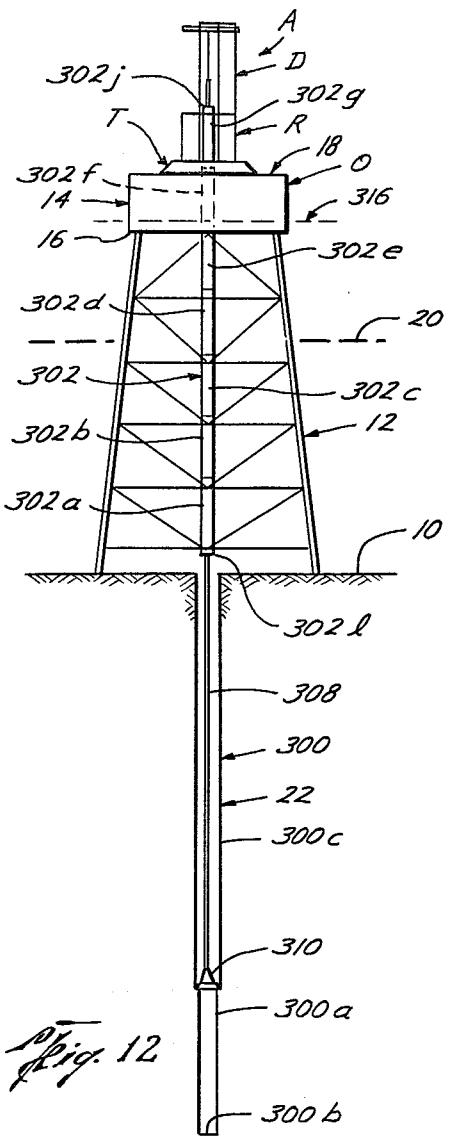
FIG. 12 shows an elevational, schematic view of the auxiliary offshore rig mounted on an offshore platform as used in a drilling operation after positioning of the guide string.

As is shown partially in FIG. 1 and schematically in FIGS. 12–14, the offshore platform O is adapted to be positioned and mounted on the ocean floor or mudline 10. The offshore platform O includes a supporting tower 12 having appropriate lattice work 12*a* to provide the necessary support thereof for supporting the upper portion 14 of the offshore platform O. The upper portion 14 houses the cellar deck 16 at the lower surface thereof and platform floor 18 at the upper surface thereof. The supporting tower 12 elevates the upper portion 14 of the offshore platform O above the water line, designated generally as 20. The offshore platform O is positioned on the ocean floor 10 such that multiple potential wells may be drilled or serviced. Such wells as well designated generally as 22 (FIGS. 12–14) may include oil wells, gas wells, water wells, or any type of wells necessary to have operations performed thereon by the offshore platform O with its attendant primary offshore rig P and auxiliary offshore rig A of the present invention. Each well 22 having operations to be performed thereon by the offshore rig O has its own particular well service opening 24 such as opening 24*a* (FIG. 1) formed on the platform floor 18 of the offshore platform O. Such well service openings 24 are positioned substantially over the center line of the well 22 or substantially over the center line of the proposed well 22. Typically, such well service openings 24 are formed in a rectangular grid pattern and disposed about the platform floor 18.

The offshore platform O further includes platform skid beams 26, 28 that are mounted with the platform floor 18 of the offshore platform O. As pictured in the drawings, preferably the platform skid beams 26, 28 are of a T cross-section however, any other suitable configuration may be used. As such, the platform skid beams 26, 28 have an upper portion 26*a*, 28*a* (FIG. 1) which are adapted to support the auxiliary offshore rig A and primary offshore rig P as discussed more fully hereinbelow. Platform skid beams 26, 28 furthermore are preferably mounted on the offshore platform O such that they are substantially parallel to one another and are adjacent the peripheral edges of the upper portion 14 of the offshore platform O such that the well service openings 24 are disposed therebetween the platform skid beams 26, 28. As shown in FIG. 1, it is preferred that there are four such well service openings 24 aligned in row between and substantially perpendicular to the platform skid beams 26, 28; however, any other suitable number aligned well service openings 24 may alternatively be used.

The primary offshore rig P is adapted to be mounted on the platform skid beams 26, 28 of the offshore platform O by means of rig supports 30, 32 (FIG. 1). The rig supports 30, 32 are joined together by appropriate bracing 34 which locates the rig supports 30, 32 with respect to one another. The central housing portion designated generally as 36 having tower 38 mounted thereon, is typically movably mounted atop rig supports 30, 32 such that the primary offshore rig P may move along the rig supports 30, 32 and with the rig supports 30, 32 being capable of movement along the platform skid beams 26, 28 to permit alignment of the primary offshore rig P over any well service opening 24 of the offshore platform O, and thus be aligned with the center line of the well 22. Such a primary offshore rig P is well-known in the industry and may be of any conventional design. The construction and details of such a primary offshore rig P does not constitute nor is any part of the present invention other than the auxiliary offshore rig A of the present invention is adapted to be used initially as a primary offshore rig or alternatively in conjunction with the primary offshore rig P upon the same offshore platform O, with the primary offshore rig P and auxiliary offshore rig A adapted to perform simultaneously different tubular member-cable operations as it relates to well activities.

The auxiliary offshore rig A of the present invention is adapted to be used in conjunction with the primary offshore rig P, with both being mounted on the platform skid beams 26, 28 of the offshore platform O. The auxiliary offshore rig A is for relieving the primary offshore rig P of well activities relating to tubular member or cable operations. Tubular members M may include drill pipe 40, casing 42, guide string 44 or any other suitable type of generally cylindrically shaped, hollowbore tube, cable or pipe, physically used in well operations.

The auxiliary offshore rig A of the present invention includes a truss member T mounted for movement along the platform skid beams 26, 28 of the offshore platform O. The truss member T includes a base chord portion 46 and an upper chord portion 48. The base chord portion 46 is adapted to be supported by and movably mounted upon the platform skid beams 26, 28 of the offshore platform O. The base chord portion 46 includes chord portions 46*a*, 46*b* (FIGS. 1, 10, 15) with the chord portions 46*a*, 46*b* being substantially parallel to one another and adapted to ride or skid upon the upper portion 26*a*, 28*a* of the platform skid beams 26, 28. The chord portions 46*a*, 46*b* preferably are joined by multiple, substantially parallel lower truss beams 46*c* to maintain the substantially parallel relationship of chord portions 46*a*, 46*b* with respect to one another and for also defining substantially equal, preferably rectangular, openings 46*f* formed in the base chord portion 46 of the truss member T between chord portions 46*a*, 46*b* and adjacent lower truss beams 46*c*. Appropriate flanges 46*d* are preferably formed with chord portions 46*a*, 46*b* adjacent the longitudinal end portions thereof for securing such chord portions 46*a*, 46*b* with the platform skid beams 26, 28 to allow movement of the base chord portion 46 along the platform skid beams 26, 28 without movement of the base chord portion 46 in the direction of its longitudinal axis with respect to such platform skid beams 26, 28.

Figure 11:
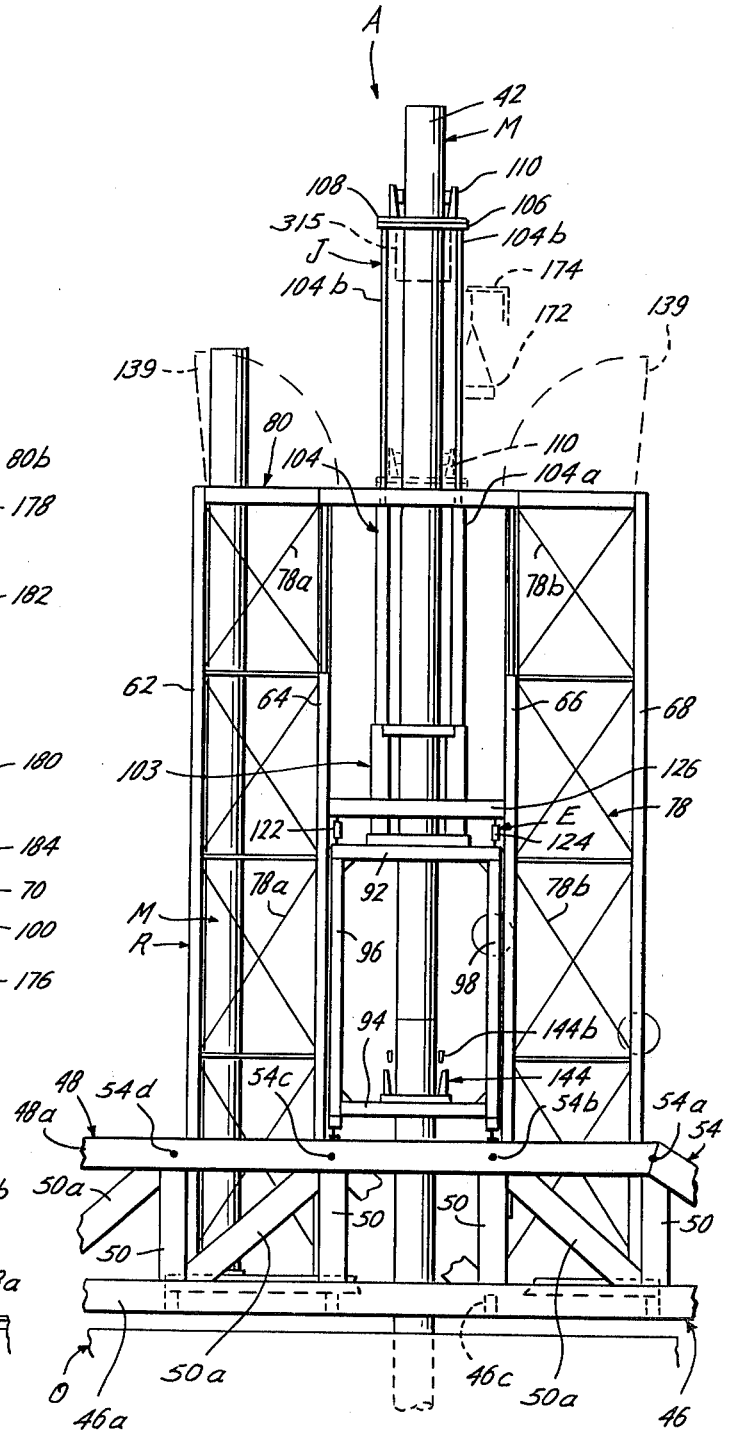
FIG. 11 is a elevational view of the auxiliary offshore rig of the present invention showing positioning of the jacking means prior to stroking the casing string downwardly for tie-back operations to subsea wellheads.

The upper chord portion 48 of the truss member T is mounted with and above the base chord portion 46. The upper chord portion 48 includes chord portions 48*a*, 48*b* which are substantially parallel to one another and parallel with chord portions 46*a*, 46*b* of base chord portion 46. Chord portion 48*a* is mounted with chord portion 46*a* by means of truss bracing 50 and chord portion 48*b* is mounted with chord portion 46*b* by means of truss bracing 52. The truss bracing 50, 52 may be substantially vertically disposed as in FIGS. 1–7 or may as, in FIGS. 8, 11, 17 include diagonal members such as diagonal bracing 50*a* in addition thereto. Irrespective of the particular configuration truss bracing 50, 52, at the point where the truss bracing 50, 52 intersects the upper chord portion 48 of the truss member T, along the center lines thereof, a panel point 54 such as panel points 54*a*, 54*b*, 54*c*, 54*d* of FIG. 11 are formed, which are discussed more fully hereinbelow. However, it should be noted that the panel points 54 are substantially in longitudinal alignment with and above the lower truss beams 46*c* along the upper chord portion 48 of the truss member T.

The auxiliary offshore rig A of the present invention further includes a racking tower R for receiving tubular members M therein. The racking tower R is mounted for movement along the truss member T and adapted to be centered over the well 22. As best seen in FIGS. 8–11 and 15, the racking tower R includes racking tower skids 56, 58 and racking tower skid braces 60 (FIGS. 1, 15). The racking tower skids 56, 58 and racking tower skid braces 60 are adapted to be movably disposed on the lower truss beams 46*c* of the base chord portion 46 of the truss member T. Preferably the racking tower skids 56, 58 are substantially parallel to one another with this relative positioning thereof being maintained by the racking tower skid braces 60. The racking tower skid braces 60 and racking tower skids 56, 58 combination are of a total width less than the length of the lower truss beams 46*c* to permit the racking tower R to be mounted on the truss member T. Locking brackets, such as bracket 59 (FIG. 15), are mounted with the racking tower R for engaging and locking the chord portions 48*a*, 48*b* together, with suitable clearance being provided therebetween the chord portions and the brackets with the the truss member T, yet position the chord portions when deflecting under loading. It is intended that multiple brackets be used, with such mounted with the racking tower R and adapted to be aligned with the panel points 54 when the racking tower R is in the proper position over the well 22. The racking tower skids 56, 58 in conjunction with the racking tower skid braces 60 form a plurality of base openings 61 (FIG. 1) in the racking tower R for receiving tubular members M therethrough. Preferably, the spacing of the racking tower skid braces 60 is such that they may be aligned with the lower truss beams 46*c* when the auxiliary offshore rig A of the present invention is positioned over an appropriate well 22 for well activities adjacent thereto.

Figure 9:
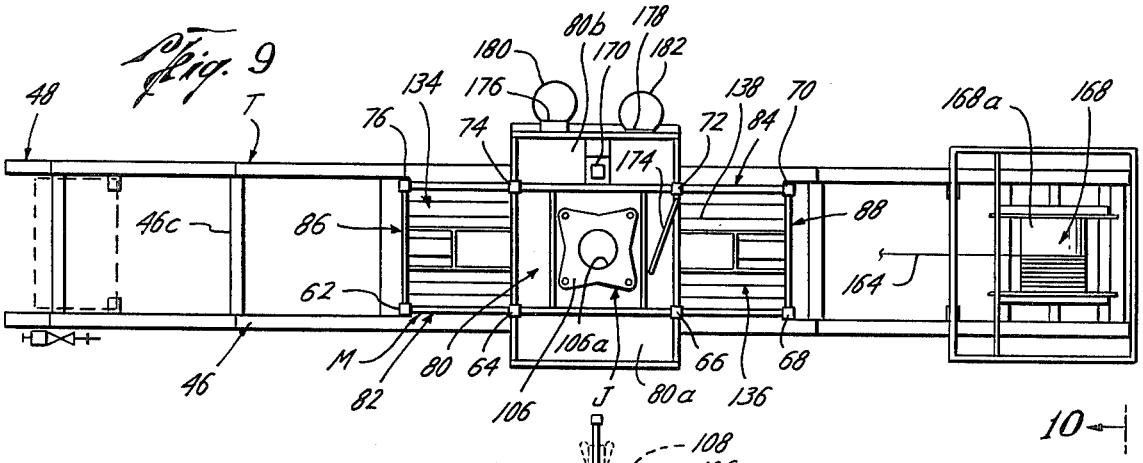
FIG. 9 is a plan view of the auxiliary offshore rig of the present invention, taken along the lines 9—9 of FIG. 8.
Figure 8:
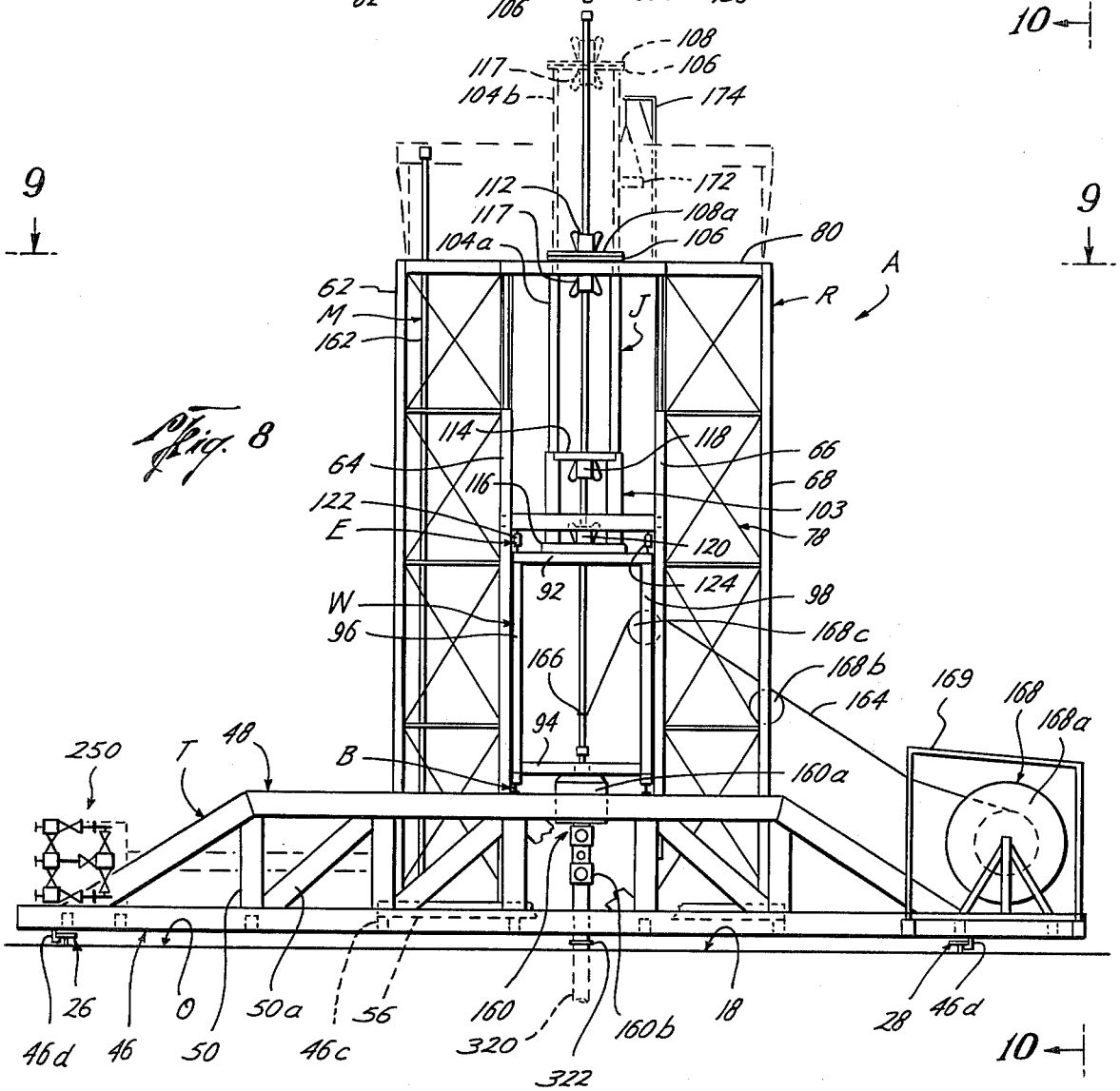
FIG. 8 is an elevational view of the auxiliary offshore rig of the present invention as used for downhole pump maintenance when removing the supporting pipe for the downhole pump from the well while reeling its associated electrical cable simultaneous with the pipe removal.

As best seen in FIGS. 8 and 9, vertical supports 62, 64, 66, 68 are mounted with racking tower skid 56 and extend upwardly therefrom and vertical supports 70, 72, 74, 76 are mounted with racking tower skid 58 and extend upwardly therefrom. Racking tower bracing 78 is appropriately positioned between various vertical supports to increase the structural integrity thereof. For example, racking tower bracing 78*a* is disposed between vertical supports 62, 64 and racking tower bracing 78*b* is disposed between vertical supports 66, 68 (FIG. 11) while racking tower bracing 78*c* is disposed between vertical supports 68, 70.

Vertical supports 62, 64, 66, 68 define a front racking tower wall section, designated generally as 82, while vertical supports 70, 72, 74, 76 define a rear racking tower wall section, designated generally as 84. Vertical supports 62 and 76 form a first racking tower side wall section 86 while vertical supports 68, 70 define a second racking tower side wall section, designated generally 88 (FIG. 9). The racking tower wall sections 82, 84, 86, 88 thus are mounted with the racking tower skids 56, 58 and extend upwardly therefrom. As such, a rig floor 80 is mounted atop and supported by the racking tower wall sections 82, 84, 86, 88 and provides a primary work area for the operators of the auxiliary offshore rig A of the present invention. As is shown in phantom in FIG. 1, suitable provisions such as safety wall or railing 90 may be provided about the rig floor 80 to prevent inadvertent stepping therefrom by the operators thereof. Furthermore, rig floor wings 80*a*, 80*b* (FIG. 10) are preferably mounted with the front and rear racking tower wall sections 82, 84, respectively, to provide additional floor space adjacent to the rig floor 80 for increased working room in the vicinity thereof for the reasons set forth below.

Figure 10:
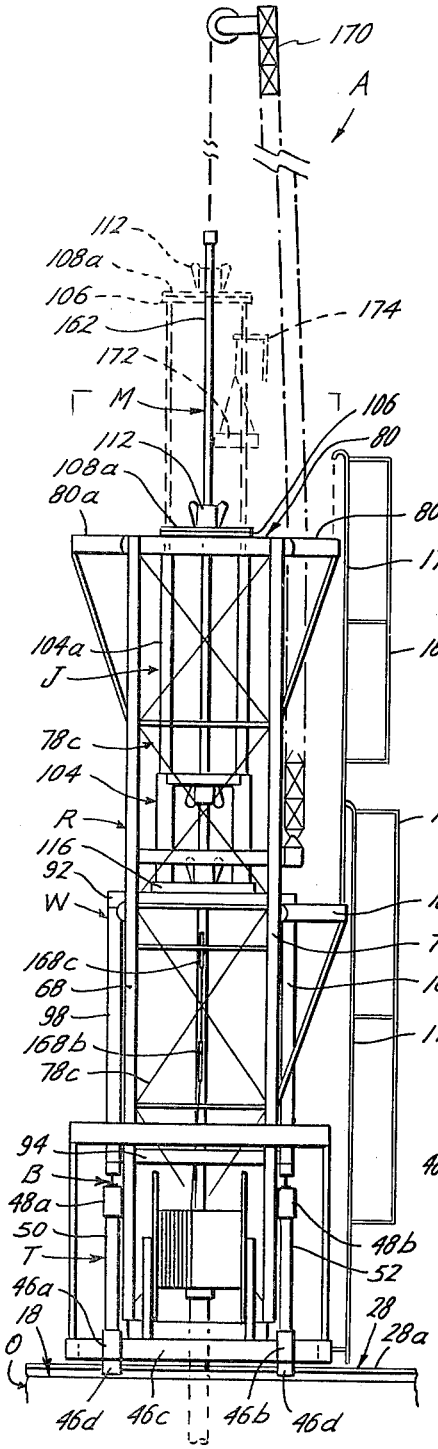
FIG. 10 is a side elevational view of the auxiliary offshore rig of the present invention, taken along the lines 10—10 of FIG. 8.

The auxiliary offshore rig A of the present invention further includes a working cage W mounted substantially within the racking tower R and supported by the truss member T. The working cage W includes a ceiling 92 and a floor 94 being mounted theretogether by vertical supports 96, 98, 100, 102 (FIGS. 8, 10, 11). Suitable openings 92*a*, 94*a* are formed in the ceiling 92 and the floor 94, respectively, with the openings 92*a*, 94*a* being in substantial axial, vertical alignment with one another and base opening 61 and adapted to be positioned in substantial axial alignment with the center line of the well 22 for receiving tubular members M therethrough. The working cage W provides a second working area adjacent the floor 94 thereof for the operators of the auxiliary offshore rig A of the present invention with this second working area being beneath the primary working area of the rig floor 80. A slip window 103 is preferably formed atop the working cage W adjacent ceiling 92 as discussed more fully hereinbelow.

The auxiliary offshore rig A of the present invention further includes jacking means J for raising and lowering tubular members M with respect to the racking tower R. Preferably, the jacking means J is mounted with the working cage W. The jacking means J preferably includes a hydraulic jack 104. Preferably the hydraulic jack 104 includes a plurality of sleeves 104*a*, having pistons 104*b* fitted therein. Preferably, the hydraulic jack 104 is of a double acting type and capable of providing lifting as well as lowering forces upon the tubular members M to be raised or lowered by means thereof. It is preferred that the jacking means J is mounted with the ceiling 92 of the working cage W with the pistons 104*b* being movable upwardly therefrom. Preferably, the sleeves 104*a* of hydraulic jack 104 extend substantially between the ceiling 92 of the working cage W upwardly to just below the rig floor 80 with the pistons 104*b* adapted to move upwardly with respect to and from the rig floor 80.

A jacking table 106 is preferably mounted adjacent the upper end of the pistons 104*b* for coordinated movement of the pistons 104*b* with respect to sleeves 104*a* of hydraulic jack 104 of the jacking means J. Preferably, the jacking table 106 is adapted to rest upon the sleeves 104*a* when in its lowermost, unactivated position and is capable of movement upwardly therefrom to the extent of travel of the pistons 104*b* within the sleeves 104*a*. An opening 106*a* (FIG. 9) is appropriately formed in the jacking table 106 for receiving various diameter tubular members M therein. It is preferred that a maximum diameter, e.g. thirty inch, casing 42 be capable of being accommodated within the opening 106*a* of the jacking table 106 and as such would require the opening 106*a* to be of a diameter slightly larger than such casing 42. However, in order to accommodate the various diameter tubular members M, a slip insert 108 is adapted to be mounted above and on the jacking table 106. However, while the slip insert 108 may have an opening formed therein suitable for working with the casing 42, should it be necessary to work with smaller diameter tubular members M such as drill pipe 40, then the slip insert 108 need only be replaced by another suitably formed slip insert 108 having a smaller diameter opening formed therein and capable of accommodating slips for engaging such smaller diameter tubular members M. For example, in FIG. 11, slips 110 are of a diameter such that, for example a twenty-two inch casing 42 may be appropriately engaged thereby, with the slips 110 being mountable over a slip insert 108 having a suitable formed opening therein to accommodate such casing 42. However, as shown in FIG. 10, instead of casing 42, should pipe 40 be in use, then slips 112 being of a significantly smaller diameter than slips 110 may accordingly be used to engage such pipe 40. It should be noted that the slip insert 108*a* is different from slip insert 108 of FIG. 11 in that slip insert 108*a* has an opening of a smaller diameter formed therein to accordingly accommodate the smaller diameter pipe 40. Thus, by appropriately sizing the slip inserts 108, 108*a* in relation to the tubular member M that is being used in a particular well operation and being performed by the auxiliary offshore rig A of the present invention, flexibility may be easily achieved by merely changing the slip insert 108, 108*a* and slips 110, 112, respectively, corresponding to tubular members M, 42, 40, respectively. It is preferred that the slip inserts 108, 108*a* be configured similar to the slip insert 307 of FIG. 18, discussed hereinbelow.

Inasmuch as the jacking means J is preferably hydraulically powered, suitable means must be provided for providing high pressure fluid to be used by the jacking means J. This could take the form of a diesel engine with a suitable fluid pump or any other suitable alternative for accomplishing this purpose and objective. Furthermore, it should be noted multiple auxiliary working areas are a result of using the small diameter tubular members M such as pipe 40. This includes auxiliary working areas adjacent members 114, 116 and are adapted to receive pipe slips 118, 120, respectively, as discussed more fully hereinbelow. This, slips 110, 112, 118, 120 comprise the slip means that is mounted with the jacking means J with the slip means being for supportably and releasably engaging the tubular members M, such as casing 42 or pipe 40 as desired.

The auxiliary offshore rig A of the present invention further includes an elevation means E for elevating the working cage W with respect to the platform floor 18 of the offshore rig O and the racking tower R. Preferably, the elevation means E includes a plurality of hydraulic jacks including hydraulic jacks 122, 124 that are mounted with the racking tower R and the ceiling 92 of the working cage W for raising and lowering the working cage W as desired. Specifically, it is preferred that the hydraulic jacks 122, 124 engage cross support 126 spanning between vertical supports 64, 66 of the front racking tower wall section 82. A similar cross support (not shown) spans between vertical supports 72, 74 for mounting additional hydraulic jacks (not shown) for providing coordinated, limited movement of the working cage W with respect to the racking tower R. Actuating the hydraulic jacks such as 122, 124 results in upward movement of the working cage W with respect to the racking tower T and upon releasing the fluid pressure therein, the working cage W moves downwardly with respect to the racking tower R, for the reasons and purposes discussed more fully discussed hereinbelow.

As shown in FIGS. 8, 10, 11 and 15, the working cage W is mounted substantially within the racking tower R and is supported by the truss member T. As best seen in FIG. 15, the vertical supports 96, 98 extend beyond the front racking tower wall section 82 and the vertical supports 100, 102 extend beyond the rear racking tower wall section 84 such that vertical supports 96, 98 are in substantial vertical alignment with the chord portions 46a, 48a of the base and upper chord portions 46, 48, respectively, and vertical supports 100, 102 are in substantial vertical alignment with chord portions 46b, 48b of the base and upper chord portions 46, 48, respectively. The working cage W is adapted to rest atop the upper chord portion 48 of the truss member T in alignment with panel points 54 and having adjustment means B disposed therebetween.

The adjustment means B is for supporting the working cage W at selected elevations with respect to the truss member T. The adjustment means B may be of any suitable adjustable support such as adjustable screw jacks 128 that are mounted with each vertical support 96, 98, 100, 102 of the working cage W and are adapted to be threadedly raised and/or lowered with respect thereto as desired. Alternatively, any other suitable adjustable mechanism capable of raising and/or lowering the working cage W with respect to the truss member T may be used as desired. Thus, the working cage W rests upon the upper chord portion 48 of the truss member T while being substantially mounted within the racking tower R. Thus, the working cage W may be raised with respect to the racking tower R upon actuation of the elevation means E. The adjustment means B may thereafter be adjusted to an appropriate, desired position, whereinafter the elevation means E may be deactivated to lower the working cage W. Working cage W, having the adjustment means B therewith, may be lowered into engagement with the truss member T through the adjustment means B for supporting the working cage W. Thus, any loading on or of the working cage W is transmitted through the adjustment means B into the upper chord portion 48 of the truss member T, through the panel points 54 thereinto the base chord portion 46, thereafter into the platform skid beams 26, 28 (FIG. 15). Similarly, any loading on the racking tower R will act through its vertical supports 62, 64, 66, 68, 70, 72, 74, 76 and its racking tower skids 56, 58 and braces 60 thereof, which directly engage the lower truss beams 46c of the base chord portion 46 of the truss member T which in turn engages platform skid beams 26, 28. Thus, all loading of either the working cage W or the racking tower R results in being ultimately supported by the platform skid beams 26, 28 of the offshore platform O.

As best seen in FIG. 16, the working cage W is constrained for substantially vertical movement with respect to the racking tower R by guide means, designated generally as 130. The guide means 130, which includes flanges 132, such as flanges 132a, 132b, is preferably mounted with the vertical supports adjacent the working cage W, such as vertical support 74, of the racking tower R. The flanges 132 constrain and limit the lateral movement of the working cage W with respect to the racking tower R so as to insure that there be no misalignment of the working cage W with respect to the truss member T and that the working cage W may only move vertically along the vertical supports of the racking tower R. As shown in FIG. 16, flange 132a is preferably secured to vertical support 74 with flange 132b being secured to flange 130a such that the vertical support 102 of the working cage W is constrained on two sides thereof. Of course, should the vertical support 102 be of a circular or any other suitable configuration in cross-section, then the flanges 132a, 132b of guide means 130 must appropriately be shaped in such a fashion to accommodate such other configuration vertical support 102. Guide means 130 are preferably mounted with the vertical supports 64, 66, 72 as well as 74 (FIG. 9) such that the working cage W is constrained to move only substantially in a vertical relation with respect to the racking tower R.

The racking tower R of the auxiliary offshore rig A of the present invention further provides a continuous, vertical mousehole for vertically storing vertical members M for tubular member operation. The vertical mousehole is formed within cavities, designated generally as 134, 136 (FIG. 9), bounded by the working cage W and the racking tower wall sections 82, 84, 86, 88. Specifically, cavity 134 is bounded by vertical supports 62, 64, 74, 76 of the racking tower R, while cavity 136 is bounded by vertical supports 66, 68, 70, 72 of the racking tower R. The cavities 134, 136 provide for the vertical disposition of the tubular members M within the cavities 134, 136 for storing thereof. Pipe rack bases 140 are adapted to be mounted within the cavities 134, 136 for maintaining the upper end of the tubular members M at the proper elevation with respect to the rig floor 80. The pipe rack bases 140, which may include an associated drop pan, may be disposed at any appropriate elevation within the cavity 134, 136 to insure the proper elevation and support of the tubular members M. It will be appreciated that adjacent the rig floor 80 appropriate pipe support fingers 138 may be formed therewith to enhance the ease in maintaining and storing such tubular members M in vertical relation, as discussed more fully hereinbelow. Alternatively, folding pipe fingers 139 (FIG. 11) may be used to hold the tubular members M in place in the racking tower R and thereafter be moved to an out of the way position as indicated in phantom in FIG. 11. Furthermore, the cavities 134, 136 provide a vertical rathole for storing a tubular member M-swivel 142, as discussed more fully hereinbelow and pictured in FIG. 3.

The auxiliary offshore rig A of the present invention further includes cage slip means, designated generally as 144, capable of supporting and releasably engaging tubular members M with the cage slip means 144 being mountable with the floor 94 of the working cage W about the opening 94a formed therein. The cage slip means 144 may include any suitable type of slip capable of supporting various diameter tubular members M. For example, the cage slip means 144 may include a casing spider 144a having its appropriately formed, compatible slip wedges 144b. Such casing spiders 144a are well-known in the industry and any suitable type may be used. For example, casing spiders as those manufactured by Varco International, Inc. of Orange, California are suitable for the auxiliary offshore rig A of the present invention. The cage slip means 144 are adapted to be mounted on slip insert 146 which is adapted to be mounted on floor 94 of the working cage W about the opening 94a formed therein. Thus, tubular members M of various diameters may be accommodated by appropriately choosing the cage slip means 144 and slip insert 146 such that they are appropriately sized to match the requirements of the particular tubular member operation that is underway. Alternatively, if no slips are needed, then the cage slip means 144 and slip insert 146 may be removed in its entirety, as shown in FIG. 8.

The auxiliary offshore rig A of the present invention further includes spooler means S mounted with the racking tower R for use in cable operations for spooling cable thereto or reeling cable therefrom. As best seen in FIG. 17, the spooler means S includes reeling drum 148 mounted with the racking tower R as well as sheaves 150, 152, 154 also mounted with the racking tower R. Preferably, sheave 156 is attached to the base of the jacking table 106 and is adapted to be movable therewith in response to movement of the jacking means J of the present invention. The reeling drum 148 is adapted to reel cable 158 therefrom or thereto with sheaves 150, 152, 154 providing sufficient frictional surface area to provide controlled reeling of such cable 158. It is preferred that the spooler means S be hydraulically powered, however, any other suitable powered spooling mechanism may be used, if so desired. It is preferred that the reeling drum 148 and sheaves 150, 152, 154 be such as those marketed by TRW, Inc. in connection with its "Reda" cable suspended pumping systems. Thus, the spooler means S of the present invention is adapted to be used in conjunction with a downhole pump (not shown) that is mounted with and supported by the auxiliary offshore rig A of the present invention by means of the cable 158. The cable 158 may have internal electrical conductors for electrically powering such a downhole pump. The spooler means S, in raising and lowering the cable 158, regulates the elevation of the downhole pump in the well 22, which is discussed in more detail hereinbelow.

It should be noted that when the cage slip means 144 is not in use with the working cage W of the present invention, that tubular safety devices 160 may be mounted with the floor 94 of the working cage W. The tubular safety devices 160 (FIGS. 8, 17) may include an annular blowout preventer 160*a* and/or a ram-type blowout preventer 160*b* either of/or both of which may be mounted beneath the floor 94 of the working cage W. Accordingly, if the elevation means E is activated and the working cage W is raised, then corresponding tubular safety devices 160 will also be raised with the working cage W as a unit. Also, the cage slip means 144 may be used in conjunction with this unit, if desired. Thus, the tubular safety devices 160 are mounted with and supported by the working cage W in alignment with the opening 94*a* in the floor 94 thereof and is capable of vertical movement with the working cage W. A stripper rubber 161 may be mounted with the floor 94 of the working cage W for controlling the well pressure from the atmosphere. The stripper rubber 161 further acts as a wiper for cleaning the cable 158 as it is withdrawn from the well 22. In order to replace the stripper rubber 161 upon wearing out the blowout preventers 160*a*, 160*b* need only be closed for safe replacement thereof.

In similar fashion, the auxiliary offshore rig A of the present invention may be used with various downhole pumps that may be supported by a tubular member M such as pipe 162 (FIG. 8). In this instance, it is necessary that an electrical cable 164 be attached to the pipe 162 by means of bands 166 prior to lowering of the pipe 162 into the well 22. The reeling of the electrical cable 164 may be accomplished by electrical cable spool means, designated generally as 168, which may include cable spool 168*a*. Cable spool 168*a* may be powered by any suitable means such as hydraulics or the like. A guide sheave 168*b* preferably is mounted with the racking tower R with the second racking tower side wall section 88 while guide sheave 168*c* is preferably mounted with the working cage W for movement therewith for use as described more fully hereinbelow. It will be appreciated that if the downhole safety device should be hydraulically operated, then cable 164 may include a hydraulic line in addition to the electrical line, both of which would require reeling on separate spools, such as 168*a*. Further, in the event of inclement weather, the electrical cable spool means 168 may be housed in an enclosure 169 to ward off the effects of the bad weather. The enclosure 169 may be heated, for example, to prevent deteriation and embrittlement of the cable's external coating.

The auxiliary offshore rig A of the present invention further includes a gin pole 170 (FIGS. 9, 10) mounted with the racking tower R and extending upwardly therefrom for supporting, raising and lowering tubular members M as desired through the opening 80*c* formed in the rig floor 80 for further aligned raising and lowering of the tubular member M through openings 92*a*, 94*a* formed in the ceiling 92 and floor 94 of the working cage W. The gin pole 170 is of a limited capacity and is preferably used in supporting, raising and lowering relatively lightweight tubular members M such as pipe 162 as distinguished from the typically very heavy types of tubular members M such as casing 42.

The auxiliary offshore rig A of the present invention further includes power tongs 172 that are pivotally mounted with the rig floor 80 by means of power tong support 174. The power tong support 174 allows the power tongs 172 to be moved in and out of position as they are needed in the makeup and breaking of joints between adjacent tubular members M either adjacent jacking table 106 or adjacent cavities 134, 136 where tubular members M are racked. Further, ladders 176, 178 having their respective safety caging 180, 182 are preferably mounted with the rear racking tower wall section 84. Ladder 180 provides access to the platform 184 mounted with the rear racking tower wall section 84 substantially adjacent to the ceiling 92 of the working cage W and ladder 182 provides access to the rig floor 80 for the operators thereof (FIGS. 9, 10). The ladders 180, 182 may be mounted with any racking tower wall section 82, 84, 86, 88, as desired.

The auxiliary offshore rig A of the present invention further includes a drill tower D mounted with the racking tower R for use in drilling operations with the tubular members M. The drill tower D is shown in use in FIGS. 1–7, 12–14, and as shown is mounted atop the racking tower R. The drill tower D is formed preferably of vertical support members 186, 188, 190, 192, 194, 196 (FIG. 1). Vertical support members 186, 188, 190 form the front drill tower wall section designated generally 98 while vertical support members 192, 194, 196 form the rear drill tower wall section designated generally 200. Vertical support members 186, 196 form the first side drill tower wall section designated generally 202 and vertical support members 190, 192 form the second side drill tower wall section designated generally 204. Adjacent the upper end of the vertical support members, top members 206, 208, 210, 212 join together to form top drill tower wall section designated generally 214. Bracing members 216 support and properly space the vertical support members 186, 188, 190, 192, 194, 196. However, preferably there is no bracing between vertical support members 186, 196 of the first side drill tower wall section 202 to form a vertical opening for providing a working window designated generally 217 for moving tubular members M therethrough, as discussed more fully hereinbelow.

Crown block support means designated generally as 218 is preferably mounted with the top drill tower wall section 214 and may include two substantially parallel crown block tracks 218*a*, 218*b* supported by the top drill tower wall section 214, for supporting the crown block means C.

The auxiliary offshore rig A of the present invention further includes crown block means C movably mounted with the crown block support means 218 for movement therealong. The crown block means C is adapted to be positioned in substantial axial vertical alignment with the center line of the well 22 and in selected, substantially parallel positions with respect thereto for the reasons discussed more fully hereinbelow. The crown block means C includes a first crown block 220 and a second crown block 222, each movably mounted with the crown block tracks 218*a*, 218*b* for movement therealong.

The first crown block 220 and second crown block 222 each have sheaving 220*a*, 222*a*, respectively, mounted therewith with the sheaving 220*a*, 222*a* forming sheaving means designated generally as 224. Each of the crown blocks 220, 222 have rollers 220*b*, 222*b*, respectively, with rollers 220*b* engaging crown block tracks 218*a*, 218*b*, and rollers 222*b* similarly engaging crown block tracks 218*a*, 218*b*. The sheaving 220*a*, 222*a* of crown blocks 220, 222 is preferably disposed between the crown block tracks 218*a*, 218*b* of the crown block support means 218 and supported by carriages 220*c*, 222*c*, respectively, which in turn is supported by rollers 220*b*, 222*b*, respectively. As is shown, it is preferred that there be a plurality of rollers 220*b* for the first crown block 220 and a plurality of rollers 222*b* for second crown block 222. Furthermore, it should be noted that the rollers 220*b*, 222*b* may be formed into the shape of gears and engage an appropriately geared pathway formed with the crown block tracks 218*a*, 218*b* for positive engagement therebetweeen, with such a gear-track arrangement being controllable by a user thereof standing on the rig floor 80 of the racking tower R. In such an instance, such may be hydraulically, electrically or in any other suitable way powered for power movement thereof. Furthermore, preferably suitable protection is provided to prevent the simultaneous centering of both crown blocks 220, 222 over the well 22. Such protection (not shown) may, for example, take the form of a hydraulic interlock and stroking device that will limit the travel of the crown blocks 220, 222 along the crown block support means 218 such that crown block 220 (FIG. 2) may move from left extremity of the support means 218 to the center line of the well 22 and crown block 222 may move from the right extremity of support means 218 to the center line of the well 22, with the crown blocks 220, 222 being incapable of both occupying the center line position simultaneously.

The sheaving means 224 of the crown block means C operatively supports travelling block designated generally 226 which includes blocks 228, 230. Block 228 is supported by cable 232 which operatively engages sheave 220*a* of first crown block 220. In similar fashion, block 230 is supported by cable 234 which extends between and is operatively supported by sheaving 222*a* of the second crown block 222. Hooks 236, 238 may be formed with the blocks 228, 230 of the travelling block 226. The travelling block 226 is used for supporting and substantially vertically raising and lowering tubular members M with respect to the racking tower R and for providing coordinated, simultaneous raising and lowering of the tubular members M for reducing the tripping time of the tubular members M in and out of the well 22 as discussed more fully hereinbelow.

Figure 3:
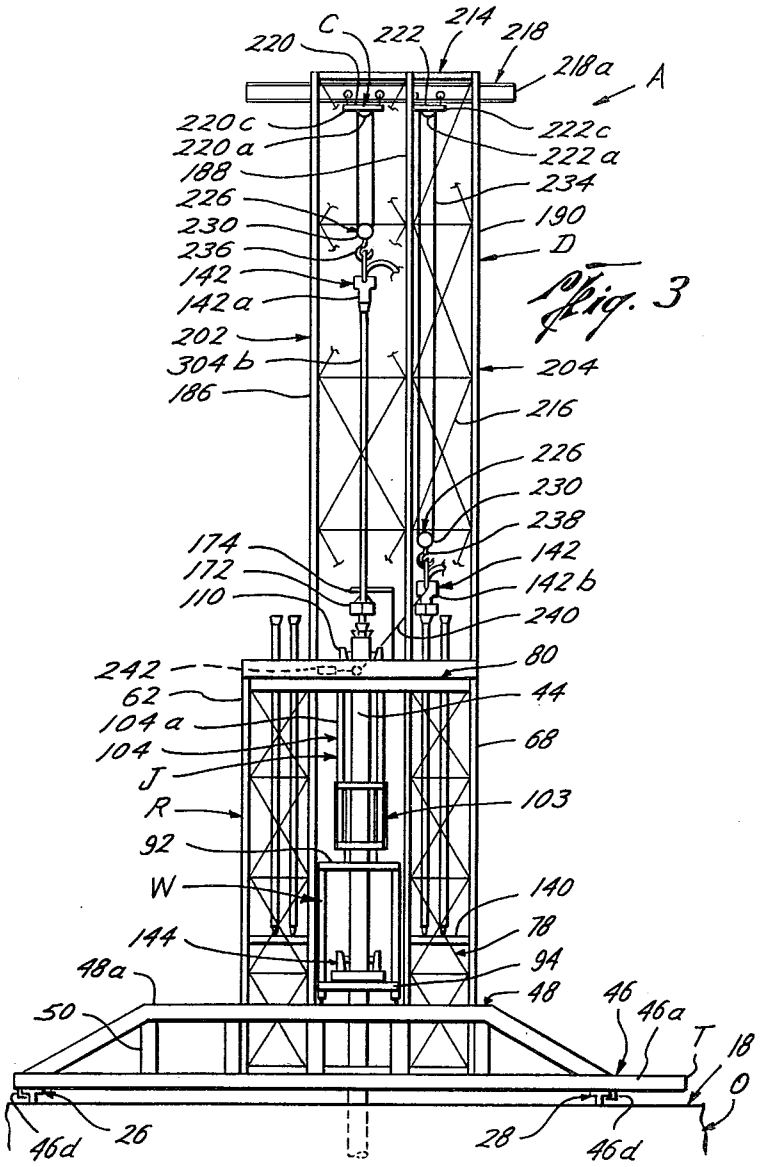
FIG. 3 is an elevational view of the auxiliary offshore rig of the present invention as used for making up the drill string for use in a drilling operation in coordination with preparing a second drill pipe for use in the drill string.
Figure 2:
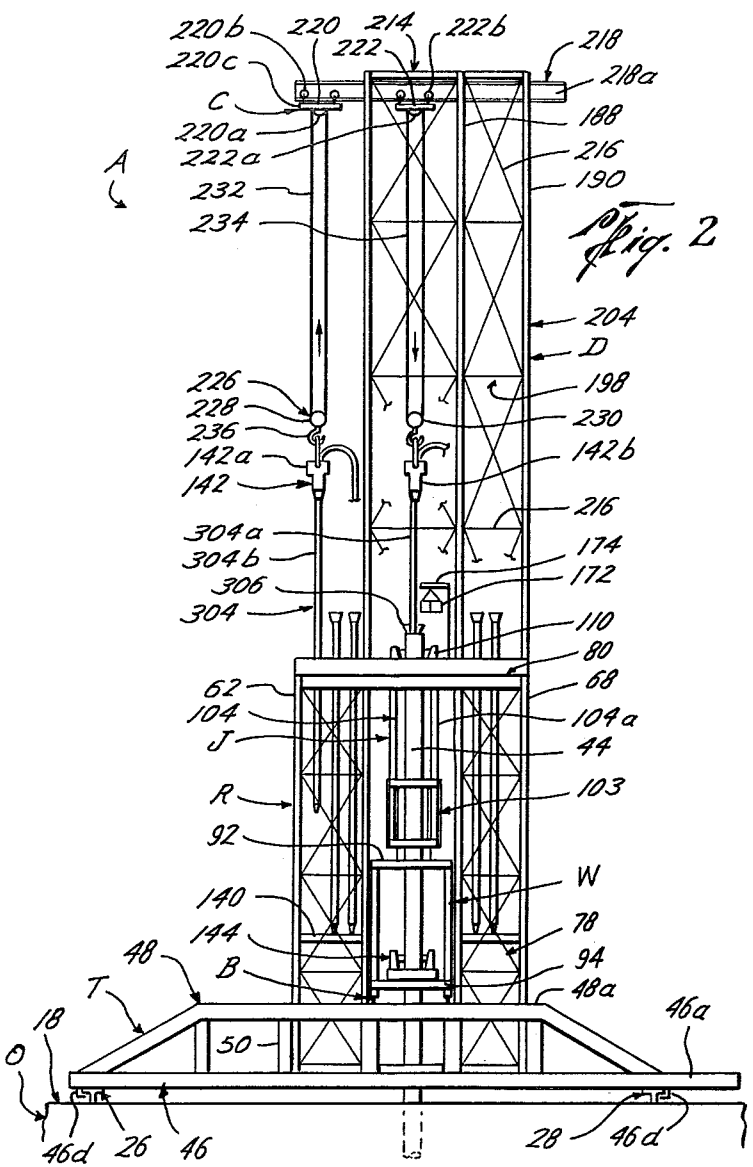
FIG. 2 is an elevational view of the auxiliary offshore rig of the present invention showing a drilling operation in progress with coordinated simultaneous rising and lowering, hence drilling, of drill pipe.
Figure 4:
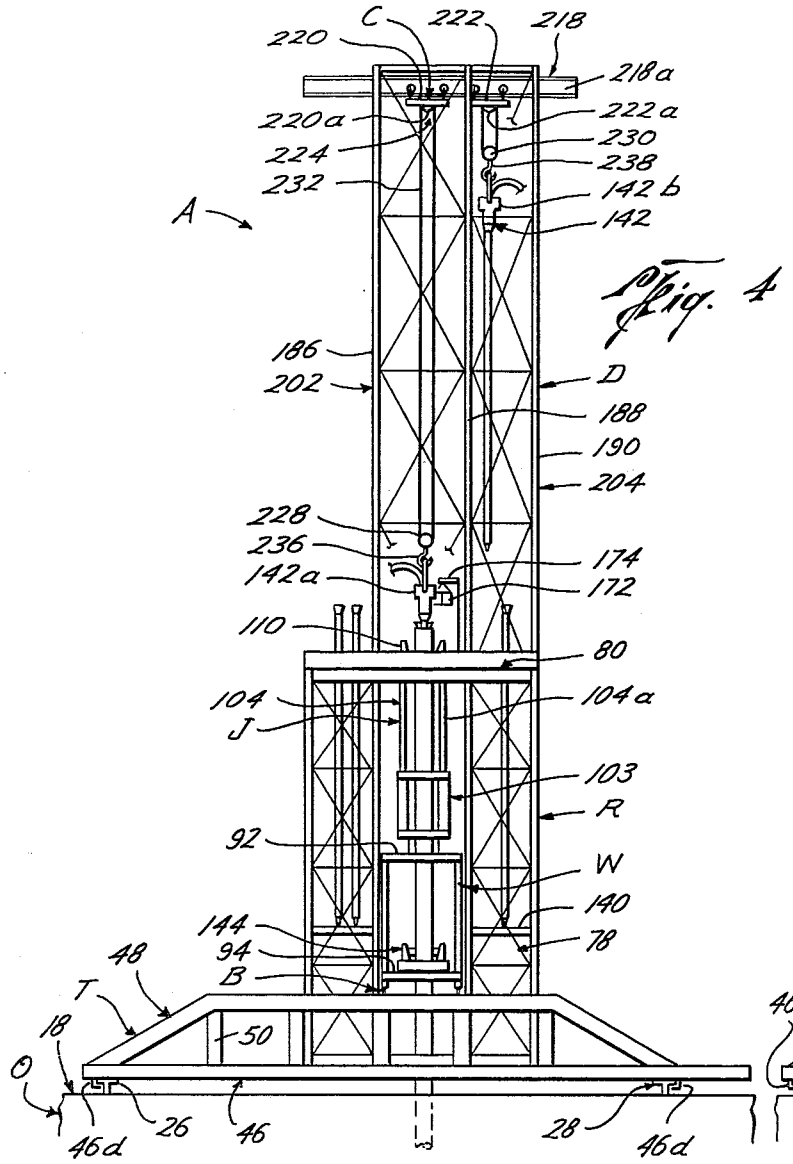
FIG. 4 is an elevational view of the auxiliary offshore rig of the present invention as used in drilling ahead in coordination and simultaneous with picking up a single tubular member from the vertical mousehole.

The power swivel, identified hereinabove generally as 142, may include power swivel 142*a* supported by block 228, hook 236 and power swivel 142*b* supported by block 230, hook 238 as shown in FIGS. 2–4. It should be pointed out that one swivel such as swivel 142*a* is adequate for most drilling operations. Of course if two swivels 142*a*, 142*b* are in fact used, drilling fluid plumbing and valves (not shown) for each such swivel must be provided for. The power swivel 142 is capable of movement as raised and lowered by the crown block means C of the present invention or alternatively are capable of being locked onto the jacking table 106 for powered rotation of the tubular members M, as desired, in similar fashion to a rotary table. The power swivel 142 may be hydraulically powered or powered by any suitable means as is desired. To prevent the power swivel 142 from rotating during powered rotation thereof, particularly while being supported by the travelling block 226, torque line 240 (FIG. 3) is attached to outwardly extending arms (not shown) of the power swivel 142 such that the power swivel 142 may move vertically, but not being free to rotate in such a fashion for each to cross their respective cables 232, 234. It is preferred that the torque line 240 be tensioned by an appropriate tensioning device shown schematically as 242 in FIG. 3. It will be appreciated that for each power swivel 142 there necessarily will be two torque lines 240, thus requiring similar torque lines 240 and tensioning devices 242 for both power swivels 142*a*, 142*b*, if usage of two swivels is desired.

Figures 6, 7:
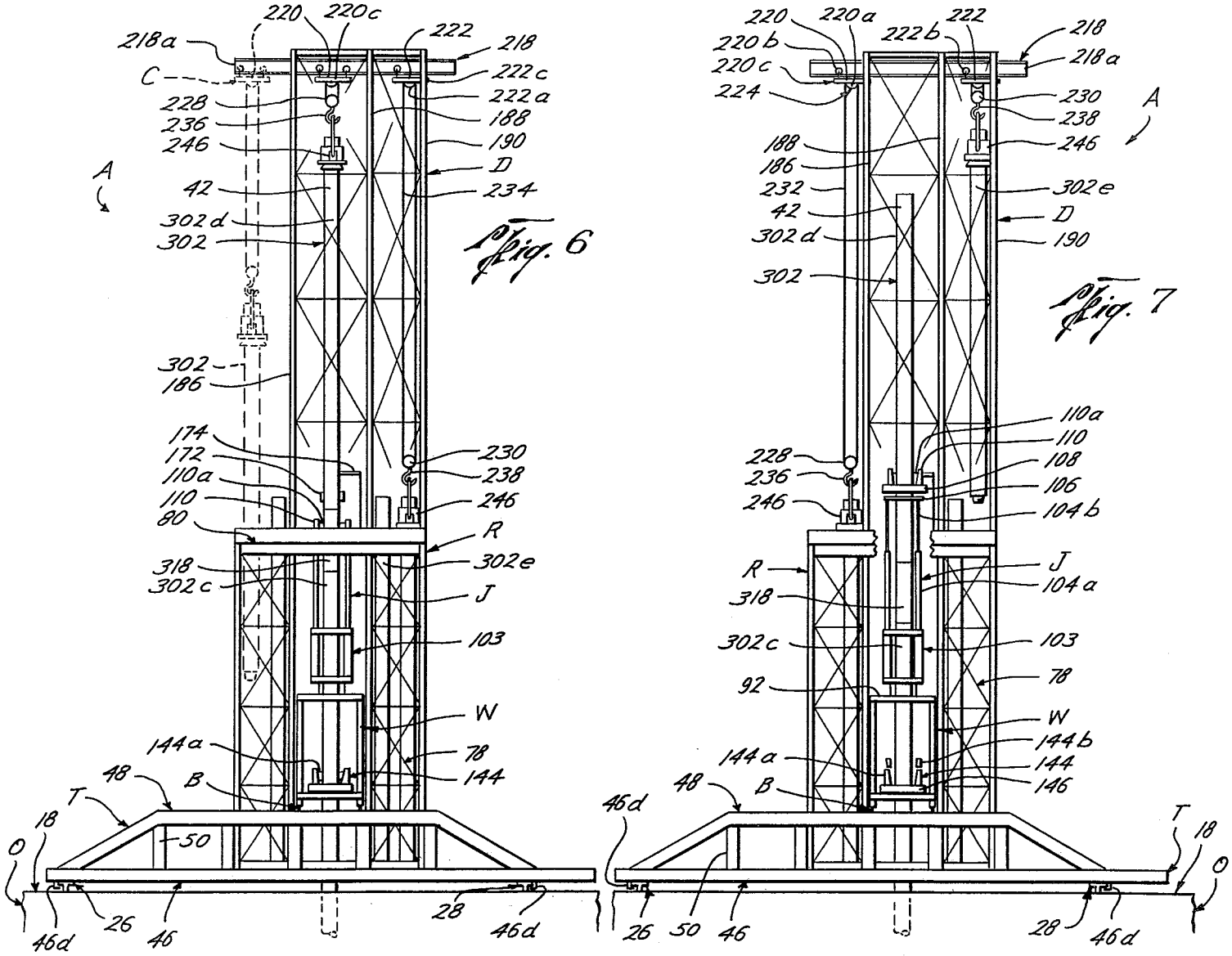
FIG. 6 is an elevational view of the auxiliary offshore rig of the present invention showing the making up of a casing joint with the casing string along with coordinated raising of adjacent casing member.
FIG. 7 is an elevational view, partly in section, showing the auxiliary offshore rig of the present invention for lowering the casing string while positioning an additional casing member in a ready position to be made up when appropriate.

The travelling block 226 is also capable of supporting drill pipe elevators 244 (FIG. 5) for engaging drill pipe 40. Alternatively, if larger diameter tubular members M are used such as casing 42 during tubular member operations about the well 22, then, the travelling block 226 and associated hooks 236, 238 are capable of supporting casing elevators 246 (FIGS. 6, 7). It is preferred that spider-type hydraulic elevators be used for elevators 244, 246, because of the elimination of the need to weld lifting lugs to the tubular members M, thus resulting in significant time savings.

Further, a typical choke manifold and hydraulic power unit designated generally as 250 (FIG. 8) for use in drilling and other tubular member operations may be mounted with the truss member T of the auxiliary offshore rig A of the present invention.

In the use or operation of the auxiliary rig A of the present invention, many different types of well activities relating to tubular member or cable operations may be performed by the auxiliary offshore rig A of the present invention. Generally, the auxiliary offshore rig A may be used for drilling, running and cementing of conductor/surface casing, predrilling for piles, drilling out piles, as a service rig, for downhole pump maintenance, for initial well completion, for re-completion of wells, and for casing tie-backs from subsea wellheads.

The operational sequence for drilling, running and cementing of the conductor/surface casing by use of the auxiliary offshore rig A of the present invention is detailed in FIGS. 2–7 and shown schematically in FIGS. 12–14. Initially, the auxiliary offshore rig A is slid on the platform skid beams 26, 28 over the appropriate well 22 that is to be drilled. Specifically, the truss member T is slid upon the platform skid beams 26, 28 and appropriately positioned over the well service opening 24. Thereafter, the racking tower R is slid upon the truss member T to an appropriate position over the specific well 300 that is to be drilled. At this point, the platform crane (not shown) of the offshore platform O delivers casing 44 to the racking tower R for making the guide string 302 for drilling through the jacket (not shown) of the offshore platform O. Preferably, the guide string 302 may be a combination of one-half inch to one inch wall thickness casing 44, particularly with the heavy wall casing in the wave zone adjacent to the waterline 20.

As shown in FIGS. 6, 7, the guide string 302 may be racked in the racking tower R after being provided thereto by the platform crane for ease of access. It is preferred that the guide string 302 be equipped with reusable connectors such as Vetco's Buttress thread tool joints or Squnch Joints. As shown in phantom in FIG. 6, casing elevator 246 may be used to engage the upper end of a guide string casing **302*d*. Activation of the crown block means C results in the raising of the guide string casing 302*d* to a position above the rig floor 80 of the racking tower R. Then, the crown block means C may be moved along the crown block support means 218, with the casing 302*d* being substantially vertically disposed until the casing is directly over and aligned with the center line of the well 300 to be drilled. Thereafter, the crown block means may be activated to lower the casing 302*d* through slips 110. If such casing is the first of the guide string as casing 302*a* (FIGS. 12, 13), then the casing 302*a* is lowered through slips 110 therethrough jacking means J therethrough cage slip means 144 mounted with the floor 94 of the working cage W into such a position that the upper end thereof is slightly above the slips 110 wherein slip wedges 110*a*, 144*a* are inserted into slips 110, 144, respectively, to securely support the casing 302*a*. Simultaneous with this operation of positioning casing 302*a* or if already positioned as casing 302*d*, elevator 246 attached to second crown block 230 may be engaging another casing 302*e* of the guide string 302 and by means of second crown block 222, be in the process of elevating the same as shown in FIGS. 6, 7. The casing 302*e* is movable in a substantially vertical position, upwardly from the racking tower R to a position elevated within the drill tower D and thereafter movable by means of the crown block means C as supported by the crown block support means 218 to a position in substantial vertical alignment over the previously disposed guide string casing 302*d*. Once the casing 302*e* is disposed in substantial axial alignment with the casing 302*d*, then the casing 302*e* may be lowered by means of the crown block means C into engagement with the casing 302*d*. Power tongs 172 are used to make up the appropriate joint between the adjacent tubular members M of the guide string 302 (FIG. 6) for appropriately making up the joint. Slip wedges 110*a* are then removed to allow stroking of the jacking means J to a position such as that shown in FIG. 7, whereinafter the slip wedges 110*a* are reinserted into slips 110 for re-engagement with the casing 302*d*. Slip wedges 114*b* are removed from cage slip means 144 and the jacking means J is used to lower the casing 302*d* into the well 300. It should be noted that the casing 302*d* may be of such a length that it may necessitate several operations of inserting slip wedges 144*b* to support the casing 302*d*, removing slip wedges 110*a* from slips 110, stroking the jacking means J upwardly, reinsertion of slip wedges 110*a* into slips 110, removal of slip wedges 144*b* from cage slip means 144, to result in further lowering of the casing 302*d* within the well 310. Further, it should be noted that because of crown blocks 220, 222, while one casing 302*d* is being lowered into the well 300 by means of the jacking means J and the appropriate coordinated action of slips 110, 144, another casing 302*e* may be handled by the second crown block 222 to result in simultaneous coordinated action of the first crown block 220 and second crown block 222 as far as simultaneous raising and lowering of the casing 302*d*, 302*e* from the racking tower R and into well 300**.

As shown schematically in FIG. 12, it is preferred that the guide string casing have a reusable wellhead joint **302*j* adjacent the upper end of casing 302*g*, which happens to be the uppermost portion of the guide string 302. Squnch joints are preferably used between casings 302*f*, 302*g* and between casings 302*g*, 302*e* with buttress tool joints preferably being used between the remaining casing members 302*a*, 302*d* to result in a guide string 302 having a lower end 302*l* terminating slightly above the mud line or ocean floor 10 with slips 110, 144 supporting the guide string 302** in such position.

Next, an appropriate bit such as a seventeen and one-half inch bit (not shown) is run through the guide string 302 by means of drill pipe 304. Again, the drill tower D with its crown blocks 220, 222 and their respective travelling blocks 228, 230 provide for coordinated simultaneous raising of the drill pipe **304*a*, 304*b* from the racking tower R and lowering the drill pipe 304*a*, 304*b* into well 300 until the drill bit nears the ocean floor or mud line 10. The power swivel 142 is used to make up this length of drill pipe. It should be noted that drill pipe slips 306 are adapted to be supported by the reusable wellhead joint 302*j* adjacent the upper end of the guide string 302 for supportable engagement with the drill pipe 304 as the drill string 308** is being made up.

As shown in FIG. 18, the drill pipe slips 306 are supported on a slip insert 307 having an opening **307*a* formed therein and suited for receiving the drill pipe 304. The slip insert 307 further includes an annular detent 307*b* allowing the slip insert 307 to be positioned over the casing 44 in axial alignment therewith. Various size openings 307*a* will accommodate various sized tubular members M as will various sized slips 306**.

At the point where the drill bit is about to commence drilling, the power swivel 142 with one joint of drill pipe 304 is added to the drill string 308 and the torque lines 240 are thereafter tensioned and drilling commences. In adding a joint of drill pipe 304, such is accomplished by setting of the drill pipe slips 306 above the upper casing member **302*g* of the casing string 302. The power swivel 142 is disconnected by the power tongs 172 and the tension in the torque lines 240 is released, such as by the removal of hydraulic fluid pressure thereto, to allow the travelling block 226 to move horizontally. Once moved, the power swivel 142 may make a connection with another joint of drill pipe 304 being racked vertically in cavities 134, 136 formed in the racking tower R, which cavities 134, 136 act as substantially vertical mouseholes. It should be noted that the power tongs 172 and power tong support 174 are pivotally mounted with the racking tower R such that the support 174 may be moved about the ring floor 80 in such a fashion that the makeup of the power swivel 142 with the drill pipe 304 while the drill pipe 304 is in the mousehole may be accomplished with the power tongs 172** insuring the makeup.

Figure 5:
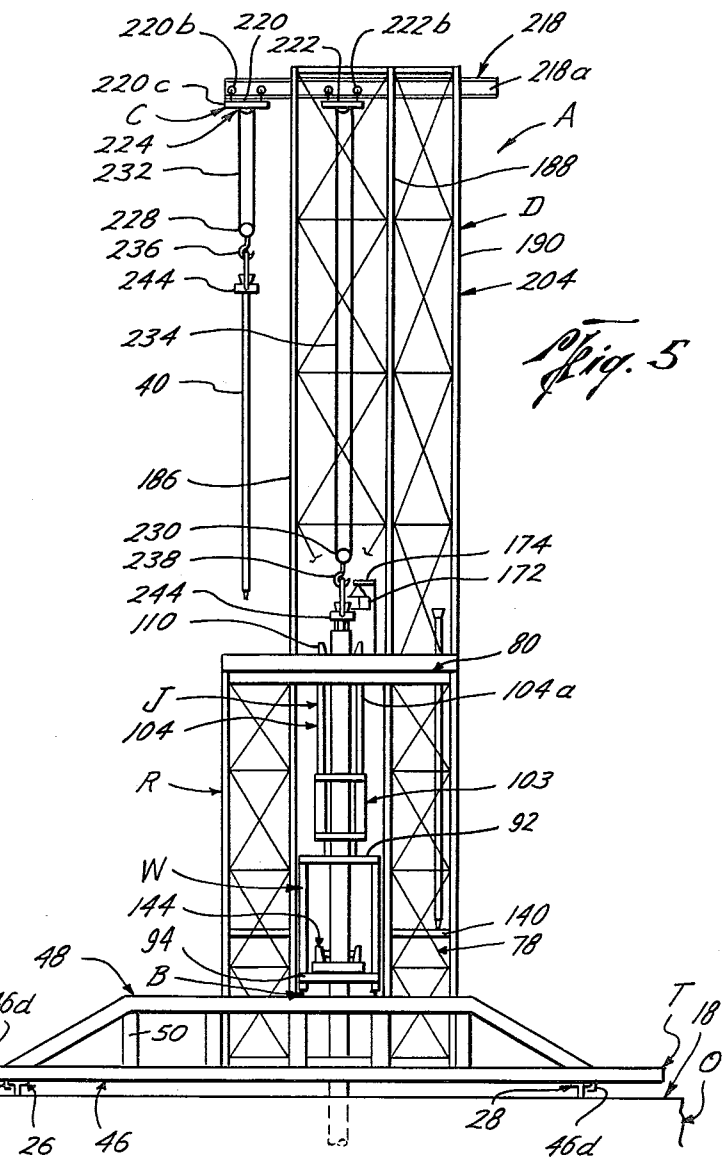
FIG. 5 is an elevational view of the auxiliary offshore rig of the present invention showing a completed drilling operation with one tubular member about to be raised out of the well simultaneous with the second tubular member being lowered onto the racking tower.

Thereafter, the drill pipe 304 is elevated and moved along the crown block support means 218 by means of crown block means C until the elevated drill pipe is in substantial alignment with the center line of the well 300, whereinafter such may be lowered and thereafter made up as part of the drill string 308. Thereafter, the torque lines 240 are tensioned and the drill pipe slips 306, which are preferably hydraulically operated, are released and drilling continues to the required predetermined depth 300*d* of the pilot hole 300*a* well 300. The drill bit is removed from the pilot hole 300*a* using the dual blocks 228, 230 and their respective crown blocks 220, 222 in the drill tower D as shown in FIG. 5. During this tripping operation, it should be noted that a drill pipe elevator 244 is supported by the travelling block 226 rather than power swivel 142, with the power tongs 172 being used to break the appropriate connections between adjoining joints of drill pipe 304 and working in coordinated action with the drill pipe slip 306. In this fashion, the tripping time to remove the drill string 308 from the well 300 is considerably reduced because of the simultaneous, coordinated dual action feature of the crown block C of the present invention. During this procedure, the power swivel 142 and one joint of drill pipe 304 may be racked in the racking tower R as shown in FIG. 3. Drill pipe elevators 244 are attached to the travelling blocks 228, 230. While one travelling block 226 is racking a single joint in the mousehole, the other is pulling the next joint out of the pilot hole 300*a* of the well 300 to be racked on the opposite side of the racking tower R.

Underreaming of the pilot hole 300*a* is carried out by an underreamer 310 (FIG. 12) which is used to enlarge the pilot hole 300*a* to that of a hole 300*c* which is an appropriate size to receive casing 312 (FIG. 13) therein. For example, the underreamer 310 could underream the pilot hole 300*a* from seventeen and one-half inches to a hole 300*c* having a diameter of substantially twenty-eight inches. The above drilling and tripping procedures for the drill string 308 are carried out in similar fashion as per the drilling of the pilot hole 300*a*, during the underreaming procedures. After completion of the underreaming, the hole 300*c* is conditioned prior to running casing 312.

At this point, it is preferred that the wellhead joint 314, which comprises casing members 314*a*, 314*b* (FIG. 13), is positioned and is preferably of a predetermined length in order to result in the casing 312 being positioned at a specified height designated generally 316, such as one foot, above the cellar deck 16 of the offshore platform O. It is preferred that the Vetco quick-connect Squnch joint be used for the wellhead assembly. Other joints of the guide string 302 can be removed depending upon the wall thickness and the placement of the cement float shoe 318 (FIGS. 6, 7, 13). As shown in FIG. 13, casing members 302*a*, 302*b*, 302*c* are used adjacent and below the cement float shoe 318 with the remaining members 302*d*–302*g* having been removed therefrom and casing 312 being used instead thereof. The casing string 312 is run as discussed hereinabove to near the depth 300*b* of the hole 300*c*. As shown in FIG. 13, the casing string 312 is followed by the cement float shoe 318 and a stinger sub. A seal is made at the cement float shoe 318 and cementing is carried out with returns to the mudline 10. After the cement has set, the casing string 12 can be released without tension being applied. To accomplish this, the jacking table 106 must have at least six to twelve inches elevation above the rig floor 80 to permit a six to twelve inch stoke of the hydraulic jack 104 in order to release the slips 110 after the cement is set. This is an advantage since tension can be dangerous to the cement bond between the casing string 312, cement and hole 300*c* of the well 300.

At this point, it is preferable that the wellhead joint is now laid down and the auxiliary offshore rig A of the present invention is skidded to its next location over another well service opening 24. As shown in FIGS. 6 and 7, the running of the casing string 312 is accomplished by using slips 110 mounted with the jacking means J of the present invention and slips 144 mounted within the working cage W of the present invention. The cage slip means 144 is set with slip wedges 144*b* in place and the wedges 110*a* of slips 110 are removed or released to allow extension of the pistons 104*b* from the sleeves 104*a* of the hydraulic jack 104 of the jacking means J, to their full extent possible. The above procedure is then reversed for lowering the casing string 312 into the predrilled hole 300. If the casing string 312 becomes stuck for any reason, then the hydraulic jack 104 can apply a downward force by adding a safety clamp 315 (FIG. 11) below the jacking table 106 on the casing string 312, up to the capacity thereof. Alternatively, lifting or jarring force may also be applied by the hydraulic jack 104 to help free such a stuck casing string 312. Similarly, if during drilling operations, drill string 308 should become stuck in the pilot hole 300*a* or hole 300*c*, then the drill pipe slips 306 can be set in the guide string 302 and the hydraulic jacks 104 of the jacking means J activated to pull or jar the drill string 308, of course subject to the design limitations of the jacking means J.

Thus, it is anticipated that by using the auxiliary offshore rig A of the present invention, significant time savings may be accomplished in that it is anticipated that the auxiliary offshore rig A may skid, rig up, and run the guide string 302 to the mudline 10 within one day, perform the drilling of the pilot hole 300*a* within one day, underream the pilot hole 300*a* to the size of hole 300*c* in a half a day, run and cement the casing string 312 within a half a day and lay down tools within a half a day resulting in a total time of three and one-half days which is believed to be better than twice as fast as such an operation could be accomplished by the primary offshore rig P, resulting in significant time and cost savings. It is believed that the costs of operating the auxiliary offshore rig A of the present invention are less than 30% the costs of operating the primary offshore rig P, yet capable of performing some of the same tasks.

The auxiliary offshore rig A of the present invention may be moved about the offshore platform O by the platform crane (not shown) because of the relatively modest weights involved such as, for example, the racking tower R including the jacking means J is approximately thirty-six kips and the truss member T including the power pack is forty-three kips.

The particular configuration of the auxiliary offshore rig A of the present invention provides ample working areas for all operations, particularly of those necessary and relating to downhole pump maintenance. It will be appreciated that the working cage W of the present invention preferably has a twelve feet floor 94-ceiling 92 height which provides room and shelter for operators involved in handling electrical cable 164 as shown in FIG. 8. With the auxiliary offshore rig A of the present invention, a three-man crew can typically handle all normal operations thereof and further the auxiliary offshore rig A's operators, upon being positioned on the rig floor 80, have and maintain excellent control and safety in moving the drill pipe 40 and casing 42 in and out of the racking fingers of the racking tower R.

The auxiliary offshore ring A of the present invention may be used for downhole pump maintenance. It is preferred that the electrical cable spool means 168 is mounted at the end of the truss member T to provide a good fleet angle for reeling of the electrical cable 164. Furthermore, the enclosure 169 can be heated to prevent embrittlement of the insulation for the electrical cable 164 during inclement weather conditions. The following operational sequence may be used in retrieving the downhole pump (not shown). Presuming that pipe 162 (FIGS. 8–10) is exposed at the christmas tree (not shown) and the electrical cable 164 is broken at the well, the downhole safety valves (not shown) are now activated. The platform crane at this point then lowers the riser 320 until it rests on the christmas tree connection. The auxiliary offshore platform A of the present invention is then skidded on platform skid beams 26, 28 of the offshore platform O over the center line of the well 22, having the blowout preventers **160*a*, 160*b* mounted with the floor 94 of the working cage W and with the working cage W in its uppermost position as regulated by the elevation means E. With the auxiliary offshore rig A appropriately positioned over the riser 320, the elevation means E is activated so as to lower the working cage W downwardly so that C-clamp connection 322 may be made between the safety devices 160 and the riser 320. The safety devices 160 including blowout preventers 160*a*, 160*b* and riser 320 attached thereto by means of C-clamp connection 322 are elevated by the elevation means E as affixed to the working cage C to raise the riser 320 from the christmas tree (not shown). A stabbing joint (not shown) is lowered to make the initial connection with the pipe 162. The electrical cable 164 are attached to the stabbing joint and the stabbing joint is then pulled upwardly to release the tubing slips. Thereafter, the working cage W-safety devices 160-riser 320** assembly is lowered onto the christmas tree for connection thereto. As such, the auxiliary offshore rig A of the present invention is in an operational mode for a downhole pump maintenance.

The pipe 162 is removed from the well 300 making the necessary stops to disconnect the bands 166 which hold the electrical cable 164 to the outside of the pipe 162 (FIG. 8). Preferably, the electrical cable 164 is connected to electrical cable spool means 168 and is appropriately tensioned for tensioned reeling onto the cable spool **168*a*. If a hydraulic line, parallel to electrical cable 164, is in use, then an appropriate hydraulic line spool (not shown) may be used for reeling the hydraulic line thereonto. As such, the pipe 162 and electrical cable 164 and hydraulic ling may be removed from the hole 300*c* of the well 300**.

It will be appreciated that when lowering the downhole pump back into the well 300, the above procedure is reversed. When the stabbing joint is attached to the pipe string 163, it is lowered until the slings (not shown) can be set in the christmas tree hanger (not shown) with the riser 320 in its upper position. The stabbing joint can now be released. Preferably, all connections are made and the well is thereafter put back on production. As shown in FIG. 8 and noted hereinabove, there are multiple working areas on the auxiliary offshore rig A of the present invention. In addition to the rig floor 80 and floor 94 of the working cage W, the slip window 103 atop the ceiling 92 of the working cage W provides another location for controlled working of slips 118, 120 if such is desired or needed, depending upon the particular operations that are to be performed. For example, if it is desired to push pipe 162 into the well 22 while the well 22 is under pressure, then inverted slips 117 are set and the jacking means J stroked downwardly to force the pipe into the well. Slips 118 must be set to maintain the pipe 162 in this downwardly position to allow resetting of the jacking means J to its upwardly full-stroke position whereinafter slips 117 re-engage the pipe 162 to further force the pipe 162 downwardly against the well pressure. Once the weight of the pipe 162 is great enough to overcome the well pressure, then slips 120 may be used in the conventional manner to support the pipe 162. Slips 120 may then be worked in coordination with slips 112 and the jacking means J for further pipe lowering, as discussed more fully hereinabove. Alternatively the slip window 103 and its associated slips may be eliminated entirely if one is not working with a pressure well.

It should be noted in the pump operations hereinabove defined that the adjustment means B in combination with the elevation means E allows for and compensates for variations in christmas tree levels. As discussed, activation of the elevation means E will raise the working cage W with the safety devices 160 attached thereto. Upon lowering of the working cage W, the adjustment means B is adjusted to engage the truss member T so that the working cage W is supported by the truss member T adjacent panel points 54 and that C-clamp connection 322 may be made with the riser 320 but with no loads existing in the riser 320 because such loads are borne and supported by the working cage W, adjustment means B, truss member T and offshore platform O.

The auxiliary offshore A further may be used in making tie-backs from subsea wellheads as shown in FIG. 11. It will be noted in this configuration that the casing 42 is lowered by downward stroking of the jacking means J such that the pistons **104*b* are retracted into sleeves 104*a* of the hydraulic jack 104 to result in downwardly lowering of the casing 42 so that position indicated when the jacking table 106 engages the upper portion of sleeves 104*a* of the jacking means J. Furthermore, it should be noted that slip wedges 144*b* are removed from cage slip means 144 to allow lowering of the casing 42 therethrough when making tie-backs from subsea wellheads. Furthermore, in the configuration of FIG. 11 is should be noted that the drill tower D may be used when performing these functions or alternatively, if not in place, the platform crane (not shown) of the offshore platform O or the gin pole 170 may be used to add singles of casing 142 to the casing string (FIG. 11**).

In the event that the auxiliary offshore rig A of the present invention is to be used for downhole pump maintenance wherein the downhole pump is suspended on a cable such as cable 158 (FIG. 17) and it becomes necessary to remove the pump and/or separate the pump from its supporting cable 158, then the jacking means J need merely be activated in such a fashion that the sheave 156 moves upwardly in response to upward movement of the jacking table 106, to provide the necessary loading on the cable 158 to sever the same adjacent the downhole pump because of the built-in "weak link" feature typically supporting the downhole pump adjacent thereto. Upon severing of the cable 158 from the downhole pump, the cable 158 may be spooled onto reeling drum 148 of the spooler means S. Thereafter, appropriate fishing tool operations may take place for retrieving the downhole pump as is well-known in the industry, but using the auxiliary offshore rig A of the present invention to provide such downhole fishing operations in accordance with the hereinabove teachings.

The auxiliary offshore rig A of the present invention may further be used for drilling at significant depths by using a rotary table (not shown) mounted with the rig floor 80 of the racking tower R in conjunction with the jacking means J controlling the weight on a bit for drilling. In order to accomplish this, it is necessary that the rotary table be of a free-wheeling type with the power swivel 142 providing rotational power for powering the bit. Slips, such as slips 110, are used to support the drill pipe 40. The lowering of the drill pipe 40 is accomplished through the jacking means J. It is preferred that a reading of the hydraulic pressure existing in the hydraulic jack 104 be made to provide a relative indication of the weight of the drill pipe 40 that is being supported by the jacking means J. Upon a determination of the desired amount of weight to be applied to the bit, the jacking means J may be used to support all or a portion of the drill pipe 40 in the drill string in such a drilling operation. Of course, a feed control system (not shown) would be necessary to properly regulate the amount of weight to be supported by the jacking means J. Therefore, the auxiliary offshore rig A of the present invention may be used to support a portion of the weight of the drill string during drilling operations thereof to apply the appropriate amount of loading to the bit, while supporting the rest of the weight thereof by means of the jacking means J.

Thus, the auxiliary offshore rig A of the present invention may be used as a service rig to do a wide variety of service operations including all standard work-over operations, milling, cementing, packing, acidizing, well clean-out, fracturing, underreaming or drilling, wireline type work (light or heavy-duty), fishing operations as well as working with large diameter casing. Furthermore, the auxiliary offshore rig A of the present invention may be used for downhole pump maintenance, initial completion work, recompletion of wells, as well as tie-backs from subsea wellheads. Also the auxiliary offshore rig A may operate during the construction phase of the offshore platform O, e.g. for setting conductor pipe, conductor casing and for drilling out pilings, all of which can save one hundred fifty to two hundred days of primary rig P time by advancing the drilling program and thereby advancing the on stream production date.

The auxiliary offshore rig A, as compared to the primary rig P, has a small footprint with respect to the offshore platform O and can be used prior to the installation of the primary rig P and continue to work in parallel with the primary rig P thereby reducing the total drilling time on the offshore platform O by well over a half a year in its ability to set casing strings to the seabed template, drill and set conductor and surface casing, relieve the main rig of downhole pump maintenance and carry out all necessary service work on completed wells. It should be noted that one of the significant features of the auxiliary offshore rig A of the present invention is the ability, due to its structure, to eliminate compressive loading on the riser 320 due to live loads, with such loading all being absorbed by the offshore platform O itself. Specifically, racking of drill pipe 40 or casing 42 on the racking tower R results in loading the base chord portion 46 of the truss member T whereas the weight of any guide string 302, drill string 308, casing string 312 will be supported either by the racking tower R or the working cage W which engages the upper chord portion 48 of the truss member T adjacent panel points 54 by means of adjustment means B resulting also in loading on the truss member T. It should be noted that as shown, it is preferred that when the auxiliary offshore rig A and particularly the racking tower R is properly positioned over the well 22, that the truss bracing 50, 52 and the respective panel points 54 are aligned with the adjustment means B, and vertical supports 96, 98, 100, 102 of the working cage W, resulting in significant loads being ultimately transferred by the truss member T, resting upon platform skid beams 26, 28, onto the offshore platform O. Also, if desired, after a connection such a C-clamp connection 322 is made, upon readjustment of the adjustment means B, the assembled unit could be placed in tension. Thus, the auxiliary offshore rig A acts differently from most conventional snubbing units which typically apply all live loads through the riser.

It is a further significant feature of the auxiliary offshore rig A of the present invention that the crown block means C and specifically the floating, dual crown blocks 220, 222, travelling blocks 228, 230 units facilitate fast tripping and double racking of the tubular members M while not only allowing substantially vertical raising and lowering of the tubular members with respect to the racking tower R, but also the racking tower R itself providing a continuous vertical mousehole for racking of multiple tubular members M for continuity of use in addition to a vertical rathole. The continuous vertical mousehole and the vertical rathole are due to the racking of the tubular members M below the rig floor 80 of the racking tower R. Furthermore, the racking tower R with its adjustable pipe racks 140 are adapted to receive tubular members M of multiple lengths, all being capable of being racked on the racking tower R, yet with their respective upper ends thereof being capable of being disposed at the proper elevation adjacent the rig floor 80. Further, the window 217 in the drill tower D allows ease in raising and lowering tubular members M into and out of the auxiliary offshore rig A. Furthermore, because of the dual crown blocks 220, 222 travelling block 228, 230 units, the auxiliary offshore rig A of the present invention, so far as known, will be able to match the speed of the primary offshore rig P in pulling tubular members M, even though the auxiliary offshore rig A is pulling single joints of tubular members M while the primary offshore rig P is capable of pulling multiple lengths at a single time. This is accomplished because of the simultaneous, coordinated movement between the crown blocks 220, 222 of the present invention.

Lastly, it will be appreciated that while the above specification deals with the auxiliary offshore rig A of the present invention for offshore applications, many of the features and advantages thereof are applicable for land based operations.

The foregoing disclosure and description of the invention are illustrative and explanatory thereof, and various changes in the size, shape and materials as well as in the details of the illustrated construction may be made without departing from the spirit and scope of the invention.

We claim:

1. An auxiliary offshore rig adapted to be used prior to, in conjunction with and subsequent to the use of a primary offshore rig mounted on platform skid beams on an offshore platform, the auxiliary offshore rig for relieving the primary offshore rig of well activities relating to tubular member or cable operations, comprising:

a truss member mounted for movement along the platform skid beams of the offshore platform;

a racking tower for receiving tubular members therein, said racking tower mounted for movement along said truss member and adapted to be centered over the well, said racking tower having racking tower skids supportively engaging said truss member and a rig floor adjacent the upper end thereof, said rig floor to provide a primary working area for the operators thereof; and, a working cage mounted substantially within said racking tower and supported by said truss member, said working cage formed with an opening therein adapted to be positioned in substantial axial alignment with the well for receiving the tubular members therethrough, said working cage to provide a secondary working area beneath said primary working area for the operators thereof.

2. The auxiliary offshore rig of claim 1, further including:

jacking means for raising and lowering the tubular member with respect to said racking tower, said jacking means mounted with said working cage.

3. The auxiliary offshore rig of claim 2, wherein:

said jacking means includes a hydraulic jack mounted on said ceiling of said working cage and extending upwardly therefrom.

4. The auxiliary offshore rig of claim 3, further including:

a jacking table adapted to be disposed adjacent said rig floor and mounted with said hydraulic jack for providing support and upward movement of said jacking table from said rig floor.

5. The auxiliary offshore rig of claim 4, wherein:

said hydraulic jack includes a plurality of hydraulic jacks that are of a double acting type for powered raising and lowering of said jacking table.

6. The auxiliary offshore rig of claim 2, further including:

slip means for supportably and releasably engaging the tubular member, said slip means mounted with said jacking means.

7. The auxiliary offshore rig of claim 1, further including:

adjustment means disposed between said working cage and said truss member for adjustably supporting said working cage at selected elevations with respect to said truss member.

8. The auxiliary offshore rig of claim 1, further including:

elevation means for elevating said working cage with respect to the platform floor of the offshore rig and said racking tower, said elevation means mounted with said racking tower and operatively engaging said working cage.

9. The auxiliary offshore rig of claim 8, wherein:

said elevation means includes hydraulic jacks mounted with said racking tower and said working cage for raising and lowering said working cage as desired.

10. The auxiliary offshore rig of claim 1, further including:

a gin pole mounted with said racking tower and extending upwardly therefrom for supporting tubular members during raising and lowering operations thereof with respect to said racking tower, as desired.

11. The auxiliary offshore rig of claim 1, wherein said racking tower further includes:

racking tower skids having a base opening formed therein for receiving tubular members therethrough;

a front racking tower wall section, a rear racking tower wall section, a first side racking tower wall section, and a second side racking tower wall section, said racking tower wall sections mounted with said racking tower skids and extending upwardly therefrom; and, said rig floor is mounted atop and supported by said racking tower wall sections, said rig floor having a rig floor opening formed therein and adapted to be substantially aligned with the well.

12. The auxiliary offshore rig of claim 11, further including:

a continuous vertical mousehole for substantially vertical storing of tubular members for tubular member operations, said vertical mousehole located within a cavity bounded by said working cage and said racking tower wall sections.

13. The auxiliary offshore rig of claim 11 wherein a power swivel is used for typical tubular member operations, further including:

a vertical rathole for substantially vertical storing of a tubular member-power swivel combination during non-use thereof in an area efficient manner about said rig floor, said vertical rathole located within a rathole cavity bounded by said working cage and said racking tower wall section.

14. The auxiliary offshore rig of claim 1, further including:

guide means mounted with said working cage for engaging said racking tower for constraining said working cage to substantially vertical movement with respect to said racking tower.

15. The auxiliary offshore rig of claim 1, wherein:

said truss member includes:

a base chord portion supported by and movably mounted upon the platform skid beams of the offshore platform, said base chord portion supporting said racking tower; and, an upper chord portion mounted with and above said base chord portion for supporting said working cage.

16. The auxiliary offshore rig of claim 15, further including:

truss bracing for mounting said base chord portion with said upper chord portion, with panel points being formed adjacent the connection of said truss bracing with said upper chord portion, said working cage adapted to be centered over and supported by said truss member adjacent said panel points.

17. The auxiliary offshore rig of claim 1, wherein:

said working cage has a floor with an opening formed therein; and, cage slip means capable of supporting and releaseably engaging the tubular member, said cage slip means mounted with said floor of said working cage about said opening formed therein.

18. The auxiliary offshore rig of claim 1, wherein:

loading forces due to the weight of multiple connected tubular members are transmitted to the offshore platform by said working cage engaging said truss member which in turn engages the platform skid beams of the offshore platform, to tension the multiple connected tubular members and prevent compressive loading forces acting upon the multiple connected tubular members.

19. The auxiliary offshore rig of claim 1, further including:

spooler means mounted with said racking tower for use in cable operations for reeling cable thereto or therefrom.

20. The auxiliary rig of claim 19, further including:

jacking means for raising and lowering the cable with respect to said racking tower, said jacking means mounted with said working cage; and, cable sheave means mounted with said jacking means for receiving cable from said spooler means and adapted to be used in severing the cable during downhole cable operational difficulties.

21. The auxiliary offshore rig of claim 1, wherein the well activities being performed require the use of a tubular safety device, wherein:

the tubular safety device is mounted with and supported by said working cage and is capable of movement with said working cage.

22. The auxiliary offshore rig of claim 1, wherein the well activities being performed include raising and lowering of a downhole pump mounted with tubular members having electrical cable attached to the outside of the tubular members, further including:

electrical cable spool means mounted with said truss member for receiving the electrical cable upon withdrawing the downhole pump, tubular members and electrical cable from the well.

23. The auxiliary offshore rig of claim 1, further including:

a drill tower mounted with said racking tower for use in drilling operations.

24. The auxiliary offshore rig of claim 23, further including:

crown block means movably mounted with a crown block support means for movement therealong;

said crown block support means mounted with the upper end of said drill tower for supporting said crown block means;

said crown block means adapted to be positioned in substantial axial vertical alignment with the center line of the well in selected, substantially parallel positions with respect thereto, said crown block means having sheaving means mounted therewith; and, a travelling block operatively supported by said sheaving means of said crown block means for substantially vertically raising and lowering of the tubular members with respect to said racking tower.

25. The auxiliary offshore rig of claim 24, wherein said drill tower further includes:

a front drill tower wall section, a rear drill tower wall section, a first side drill tower wall section, a second side drill tower wall section and a top drill tower wall section supported by said front, rear, first side and second side drill tower wall sections, said drill tower wall sections mounted atop said racking tower; and, wherein said crown block support means includes a crown block track supported by said top drill tower wall section.

26. The auxiliary offshore rig of claim 25, wherein:

said crown block means includes first and second crown blocks movably mounted with said crown block track for movement along said crown block track, said first and second crown blocks each having sheaving mounted therewith; and, said travelling block includes first and second travelling blocks operatively supported by said sheaving of said first and second crown blocks, respectively, for raising and lowering the tubular members with respect to said racking tower for providing coordinated, simultaneous substantially vertical raising and lowering of multiple tubular members for reducing the tripping time of the tubular members into and out of the well.

27. The auxiliary offshore rig of claim 1, further including:

a pipe rack adjustably mounted with said racking tower for permitting ease in the vertical racking and storing of variable lengths of tubular members with said racking tower.

28. An auxiliary offshore rig adapted to be used prior to, in conjunction with or separately from a primary offshore rig mounted on platform skid beams on an offshore platform, the auxiliary offshore rig for relieving the primary offshore rig of well activities relating to tubular member or cable operations, comprising:

a truss member mounted for movement along the platform skid beams of the offshore platform;

a racking tower for receiving tubular members therein, said racking tower mounted for movement along said truss member and adapted to be centered over the well;

a drill tower mounted with said racking tower for use in drilling operations with the tubular members;

said drill tower having a front drill tower wall section, a second side drill tower wall section and a top drill tower wall section supported by said front, rear, first side and second side drill tower wall sections, said drill tower wall sections mounted atop said racking tower;

said drill tower having crown block support means with the upper end of said drill tower including a crown block track supported by said top drill tower wall section;

a crown block means movably mounted with said crown block support means for movement along said crown block support means and adapted to be positioned in substantial axial vertical alignment with the center line of the well and in selected, substantially parallel positions with respect thereto, said crown block means having sheaving means mounted therewith; and, a travelling block operatively supported by said sheaving means of aid crown block means for substantially vertically raising and lowering of tubular members with respect to said racking tower.

29. The auxiliary offshore rig of claim 28, wherein:

said first side drill tower wall section is formed with a vertical opening providing a working window for moving tubular members therethrough.

30. The auxiliary offshore rig of claim 28, wherein:

said crown block means includes first and second crown blocks movably mounted with said crown block track for movement along said crown block track, said first and second crown blocks each having sheaving mounted therewith; and, said travelling block includes first and second travelling blocks operatively supported by said sheaving of said first and second crown blocks, respectively, for raising and lowering the tubular members with respect to said racking tower for providing coordinated, simultaneous substantially vertical raising and lowering of multiple tubular members for reducing the tripping time of the tubular members into and out of the well.

31. A method of using an offshore rig for connecting a tubular member to a service riser, comprising the steps of:

supporting the tubular member by a working cage mounted substantially with a racking tower and supported by a truss member of the offshore rig;

elevating the working cage and tubular member therewith to a point where the lower end of the tubular member is at an elevation above the upper end of the service riser;

skidding the offshore rig over the service riser such that the tubular member and service riser are in substantial axial vertical alignment;

lowering the working cage until the lower end of the tubular member just engages the upper end of the service riser; and, connecting the tubular member and service riser theretogether with a clamping connector.

32. The method of claim 31, further including the step of:

adjusting an adjustment member mounted with the working cage to engage the truss member after said lowering to prevent compressive loading on the service riser by the tubular member.

33. The method of claim 32, wherein said adjusting includes the steps of:

tensioning the service riser by adjusting the adjustment member so as to exert a lifting force on the service riser after said connecting.

34. The method of claim 31, wherein said supporting includes the steps of:

disposing tubular safety devices beneath the working cage and above the tubular member.

* * * * *